US007377414B2

(12) United States Patent
Kishi et al.

(10) Patent No.: US 7,377,414 B2
(45) Date of Patent: May 27, 2008

(54) CARTRIDGE

(75) Inventors: Kazuhiko Kishi, Tokyo (JP); Toshio Shimizu, Tokyo (JP); Kazuo Higuchi, Tokyo (JP)

(73) Assignee: Max Kabushiki Kaisha, Chuo-Ku, Tokyo (JP)

( * ) Notice: Subject to any disclaimer, the term of this patent is extended or adjusted under 35 U.S.C. 154(b) by 16 days.

(21) Appl. No.: 10/569,408

(22) PCT Filed: Aug. 27, 2004

(86) PCT No.: PCT/JP2004/012770

§ 371 (c)(1),
(2), (4) Date: Apr. 12, 2006

(87) PCT Pub. No.: WO2005/021217

PCT Pub. Date: Mar. 10, 2005

(65) Prior Publication Data

US 2006/0261123 A1 Nov. 23, 2006

(30) Foreign Application Priority Data

Aug. 29, 2003 (JP) ..... 2003-308100

(51) Int. Cl.
*B27F 7/38* (2006.01)
*B25C 5/16* (2006.01)
*B65D 85/24* (2006.01)

(52) U.S. Cl. ..... 227/120; 206/340; 227/136

(58) Field of Classification Search ..... 227/3, 227/120, 135, 137, 138, 136; 206/338, 340, 206/343

See application file for complete search history.

(56) References Cited

U.S. PATENT DOCUMENTS 3,009,618 A * 11/1961 Lerner ..... 226/162
4,793,541 A * 12/1988 Dravnieks ..... 228/52
RE33,362 E * 10/1990 Mongeon et al. ..... 206/338
5,273,199 A * 12/1993 Logtens ..... 227/87

(Continued)

FOREIGN PATENT DOCUMENTS

JP 55-143342 11/1980

(Continued)

OTHER PUBLICATIONS

A Notice of Ground of Rejection issued in corresponding Japanese Patent Application No. 2003-308100, and translation thereof.

*Primary Examiner*—Stephen F. Gerrity
(74) *Attorney, Agent, or Firm*—Buchanan Ingersoll & Rooney PC

(57) ABSTRACT

A cartridge from which a staple refill cannot be taken out until all sheet-like connected staple is discharged. A cartridge is drawably provided in a stapler body and has a receiving room for receiving a staple refill, an engagement member with which one side of the staple refill is engaged, and a lock member for locking the engagement member. The lock member has a contact portion that comes in contact with a sheet-like connected staple, discharged from a discharge opening of the staple refill, when the staple refill is received in the receiving room. When the contact portion is in contact with the sheet-like connected staple, the lock member locks the engagement member to prevent separation of the staple refill.

2 Claims, 18 Drawing Sheets

U.S. PATENT DOCUMENTS

| | | | | |
|---|---|---|---|---|
| 5,560,529 | A * | 10/1996 | Udagawa et al. | 227/136 |
| 6,050,471 | A * | 4/2000 | Yagi | 227/136 |
| 6,371,352 | B1 * | 4/2002 | Mochizuki | 227/155 |
| 6,543,667 | B2 * | 4/2003 | Yoshie et al. | 227/120 |
| 6,736,304 | B2 * | 5/2004 | Mochizuki | 227/136 |
| 6,918,527 | B2 * | 7/2005 | Hakozaki et al. | 227/131 |
| 6,974,068 | B2 * | 12/2005 | Mochizuki et al. | 227/131 |
| 7,143,921 | B2 * | 12/2006 | Hakozaki et al. | 227/120 |
| 2005/0269380 | A1 * | 12/2005 | Shimizu et al. | 227/155 |
| 2007/0009705 | A1 * | 1/2007 | Kishi et al. | 428/91 |

FOREIGN PATENT DOCUMENTS

| | | | |
|---|---|---|---|
| JP | 60-232887 | | 11/1985 |
| JP | 1-130902 | | 5/1989 |
| JP | 08-071951 | | 3/1996 |
| JP | 2002-079475 | A * | 3/2002 |
| JP | 2002-200573 | | 7/2002 |
| WO | WO-02-18111 | * | 3/2002 |

* cited by examiner (a)

(b)

(c)

(a)

(b)

(c)

CARTRIDGE

CROSS-REFERENCE TO RELATED APPLICATION

This disclosure is based upon Japanese Application No. 2003-308100 filed Aug. 29, 2003 and International Application No. PCT/JP2004/012770, filed Aug. 27, 2004, the contents of which are incorporated herein by reference.

FIELD OF THE INVENTION

The present invention relates to a cartridge which is drawably provided in a stapler and equipped with a storage chamber detachably accommodating a staple refill.

BACKGROUND OF THE INVENTION

Conventionally, for example, as disclosed in Japanese Patent Application Laid-Open No. 2002-200573 (Patent Document 1), the cartridge provided in the stapler is drawably attached to a stapler main body. The cartridge includes a storage chamber, and the staple refill is detachably attached to the storage chamber. A sheet-like connected staple wound in a roll shape is stored in the staple refill, and a leading end portion of the sheet-like connected staple is discharged from a discharge port of the staple refill. Accordingly, in usage of the stapler, the cartridge is drawn from the stapler main body to mount the staple refill on the cartridge, and the cartridge on which the staple refill is mounted is pressed into the stapler main body.

In the conventional cartridge, even if the sheet-like connected staple remains in the staple refill, the staple refill can be taken off. Therefore, the staple refill can be taken off from the cartridge while the sheet-like connected staple is partway discharged from the discharge port of the staple refill. In this case, the sheet-like connected staple is broken, which results in a problem that an obstacle such as clogging is generated.

In view of the foregoing, an object of the invention is to provide a cartridge in which the staple refill cannot be detached when the sheet-like connected staple remains and the sheet-like connected staple can be drawn from the staple main body while the staple refill is mounted when the obstacle such as the clogging is generated.

SUMMARY OF THE INVENTION

In order to achieve the object, there is provided a cartridge according to a first aspect of the invention which is drawably provided in a stapler main body. The cartridge includes a storage chamber, an engaging member, and a lock member provided in the cartridge main body. A staple refill is detachably stored in the storage chamber. The engaging member engages one side of the staple refill stored in the storage chamber. The lock member locks the engaging member, and the lock member has an abutting portion which abuts on a sheet-like connected staple discharged from a discharge port of the staple refill when the staple refill is stored in the storage chamber. The lock member is configured to lock the engaging member to prevent the release of the staple refill when the abutting portion abuts on the sheet-like connected staple, and the lock member is configured to unlock the engaging member to enable the release of the staple refill when the abutting portion does not abut on the sheet-like connected staple.

In order to achieve the object, there is provided a cartridge according to a second aspect of the invention, wherein the lock member is provided in the cartridge main body such that it can oscillate. The abutting portion is formed at one end of the lock member and a latch portion is formed at the other end, the abutting portion emerges into the storage chamber to abut on the sheet-like connected staple through a through-hole formed in the cartridge main body, and in the latch portion, the lock member oscillates in a latching direction of the latch portion to latch the engaging member when the abutting portion abuts on the sheet-like connected staple. The lock member oscillates in an unlatching direction of the latch portion to unlatch the engaging member when the abutting portion does not abut on the sheet-like connected staple.

In order to achieve the object, there is provided a cartridge according to a third aspect of the invention which is attached to a stapler for binding sheets of paper with a staple. The cartridge comprises a storage chamber in which a staple refill is detachably stored, the staple refill accommodating the staple. An engaging member prevents the release of the staple refill from the storage chamber by engaging the staple refill stored in the storage chamber; and a lock member latches the engaging member to prevent the release of the engagement between the staple refill and the engaging member. The lock member includes an abutting portion which abuts on the staple accommodated in the staple refill, the lock member latches the engaging member by abutment between the abutting portion and the staple in the staple refill, and the lock member prevents the release of engagement between the engaging member and the staple refill.

DETAILED DESCRIPTION OF THE PREFERRED EMBODIMENTS

Figure 1:
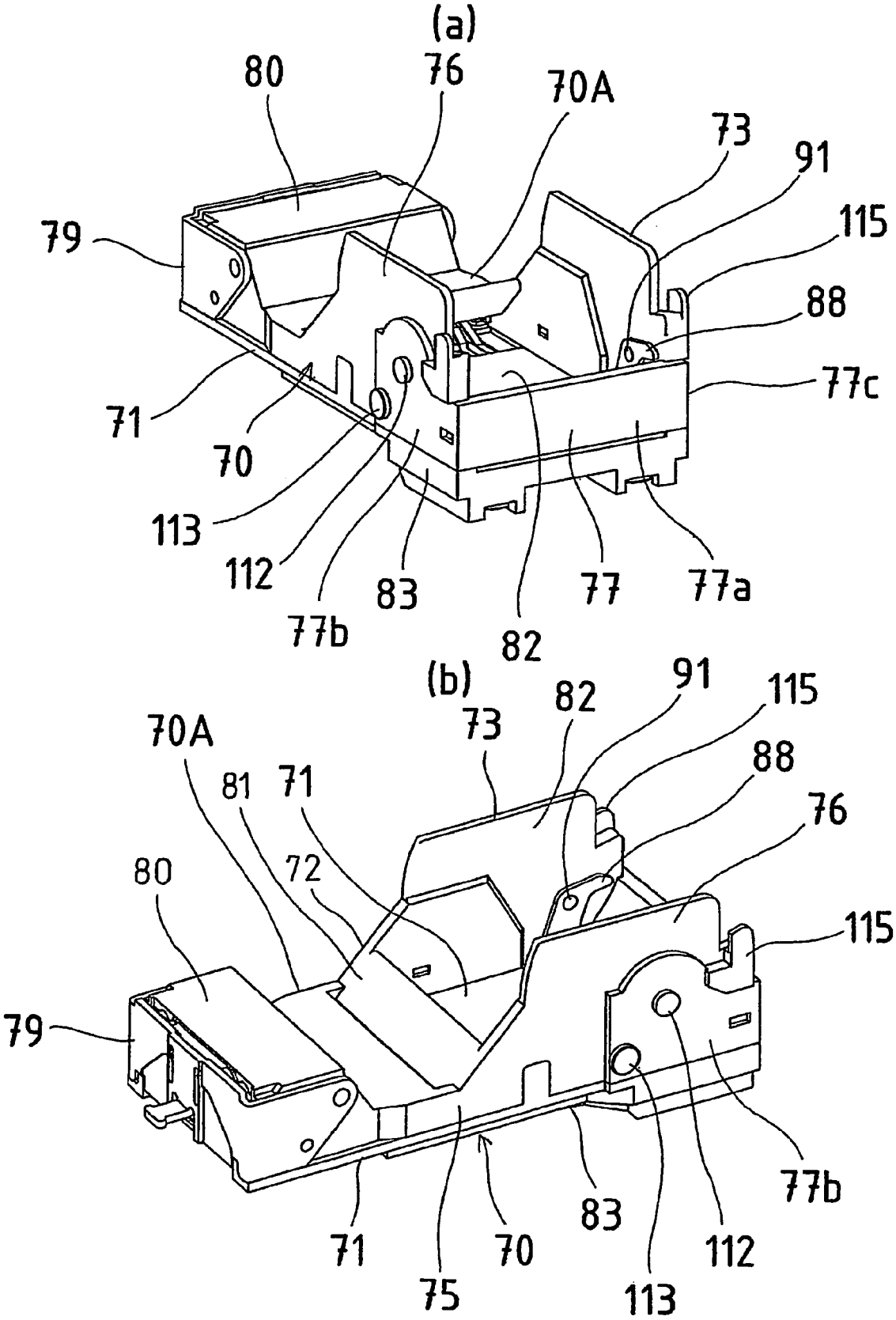
FIG. 1 is an overall perspective view showing an embodiment of a cartridge according to the invention.
Figure 2:
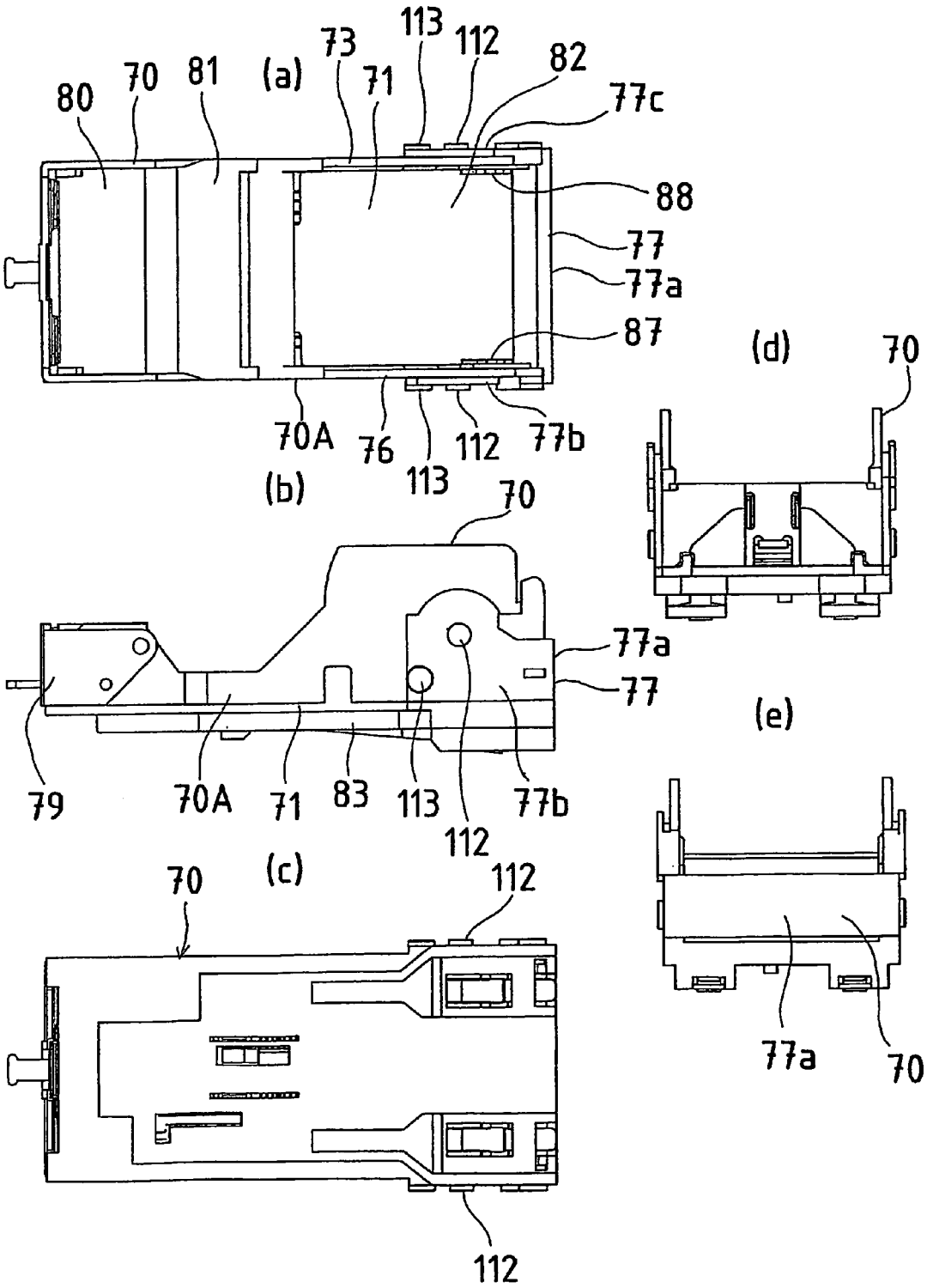
FIG. 2 is a set of six drawings showing the cartridge of FIG. 1.
Figure 3:
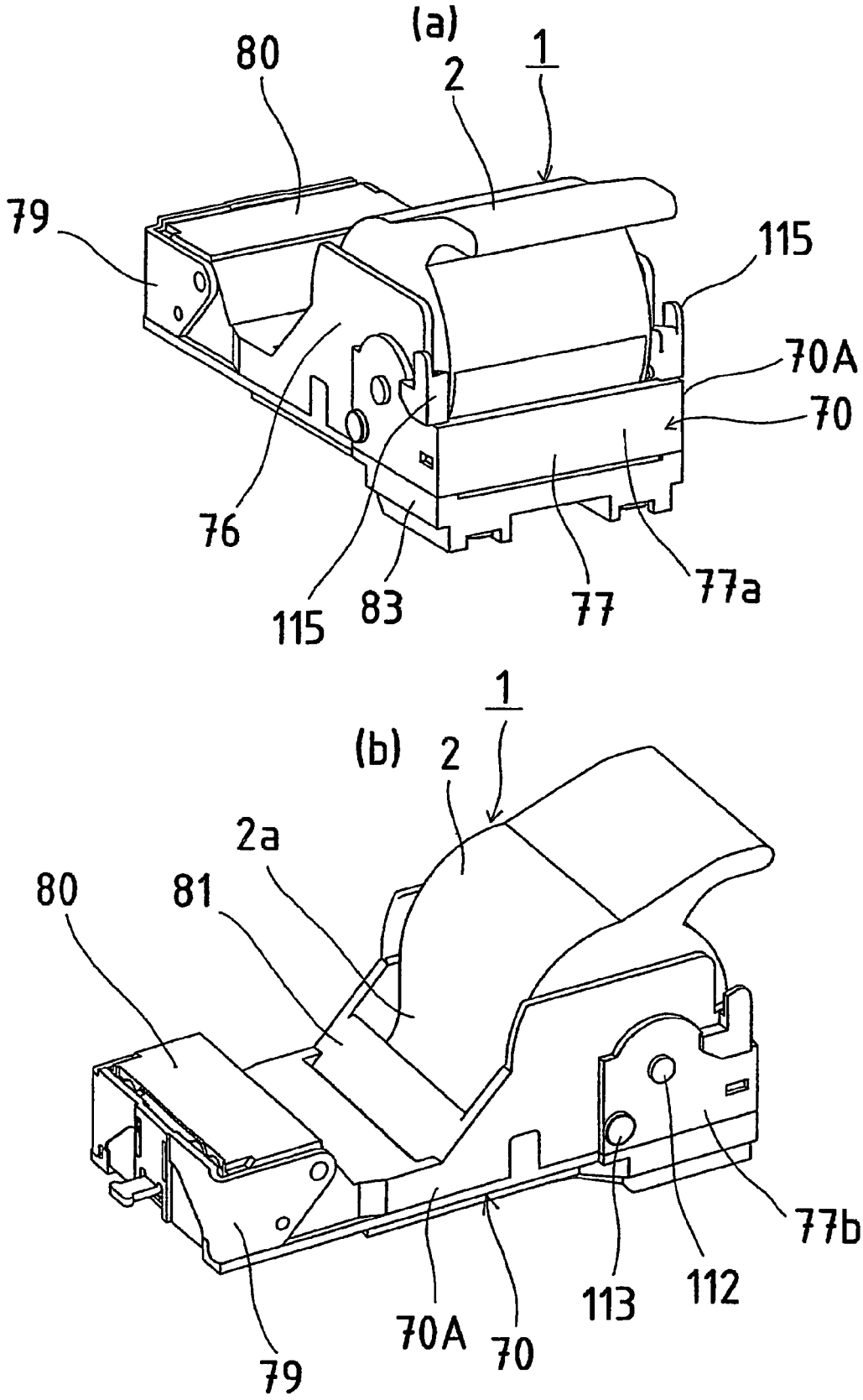
FIG. 3 is an overall perspective view showing a state in which a staple refill is attached to the cartridge of FIG. 1.
Figure 4:
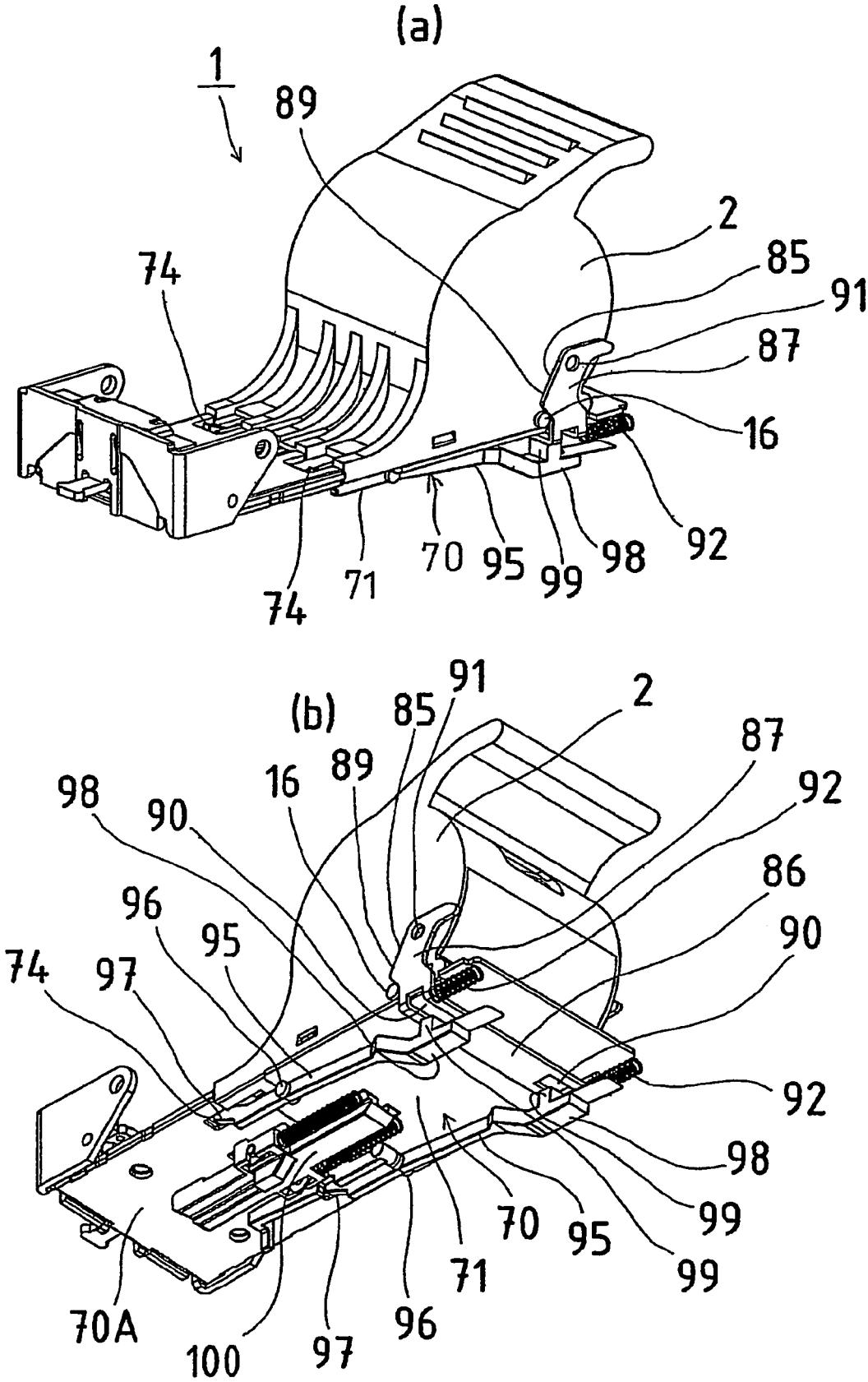
FIG. 4 is an overall perspective view in which a part of the cartridge of FIG. 3 is omitted.
Figure 5:
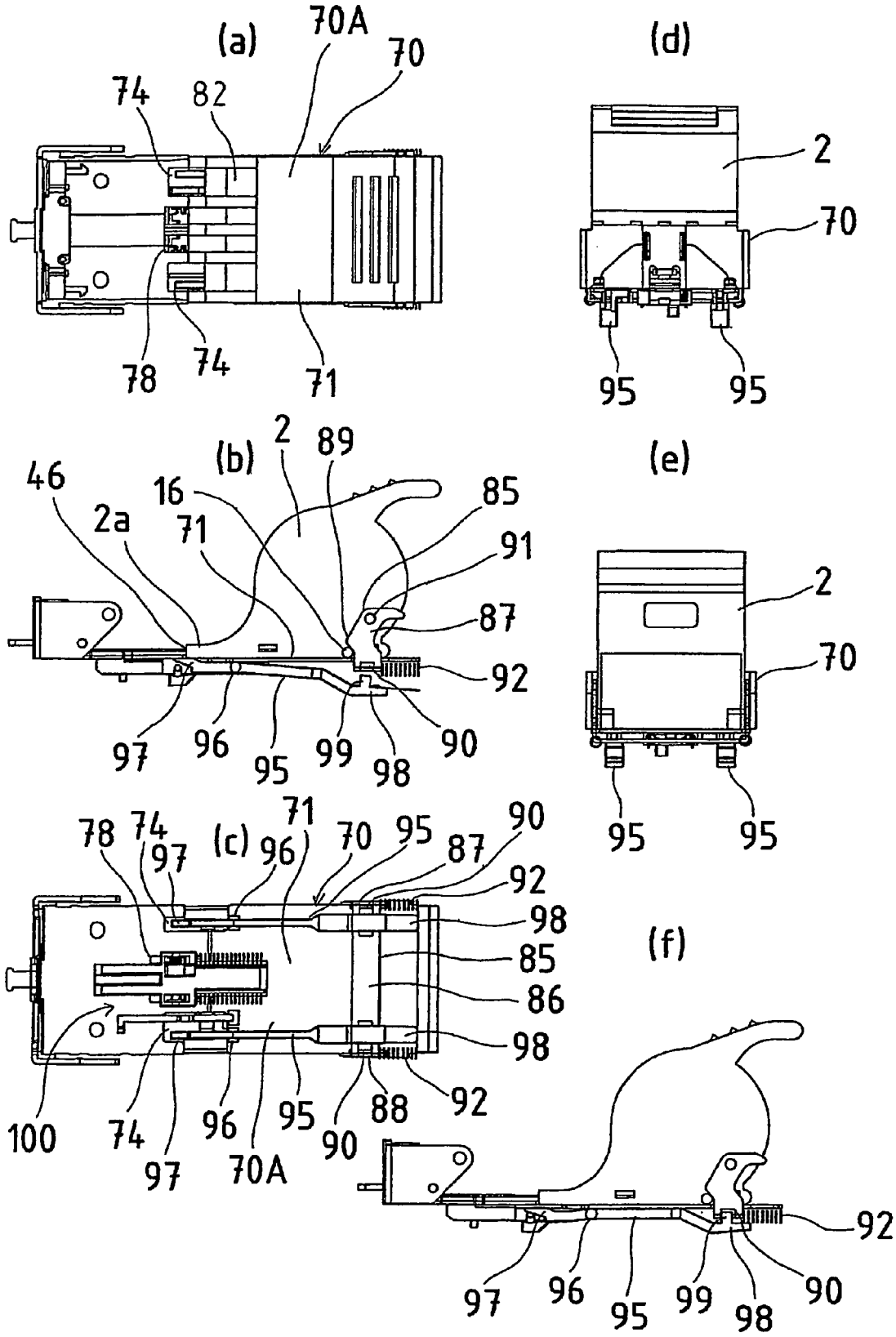
FIG. 5 is a set of six drawings showing the cartridge of FIG. 4.
Figure 6:
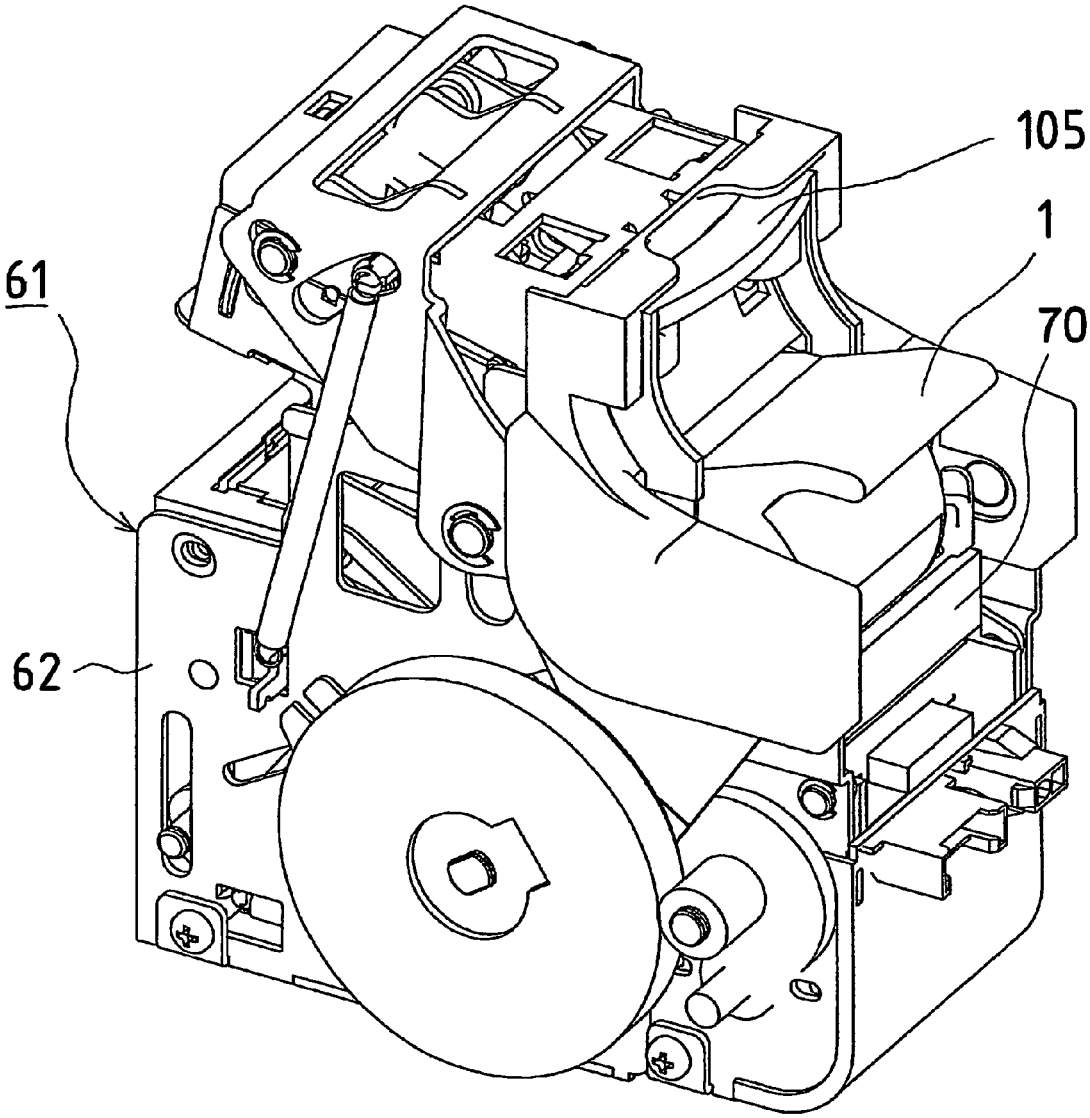
FIG. 6 is a perspective view showing a stapler main body on which the cartridge of FIG. 3 is mounted when viewed from one direction.
Figure 7:
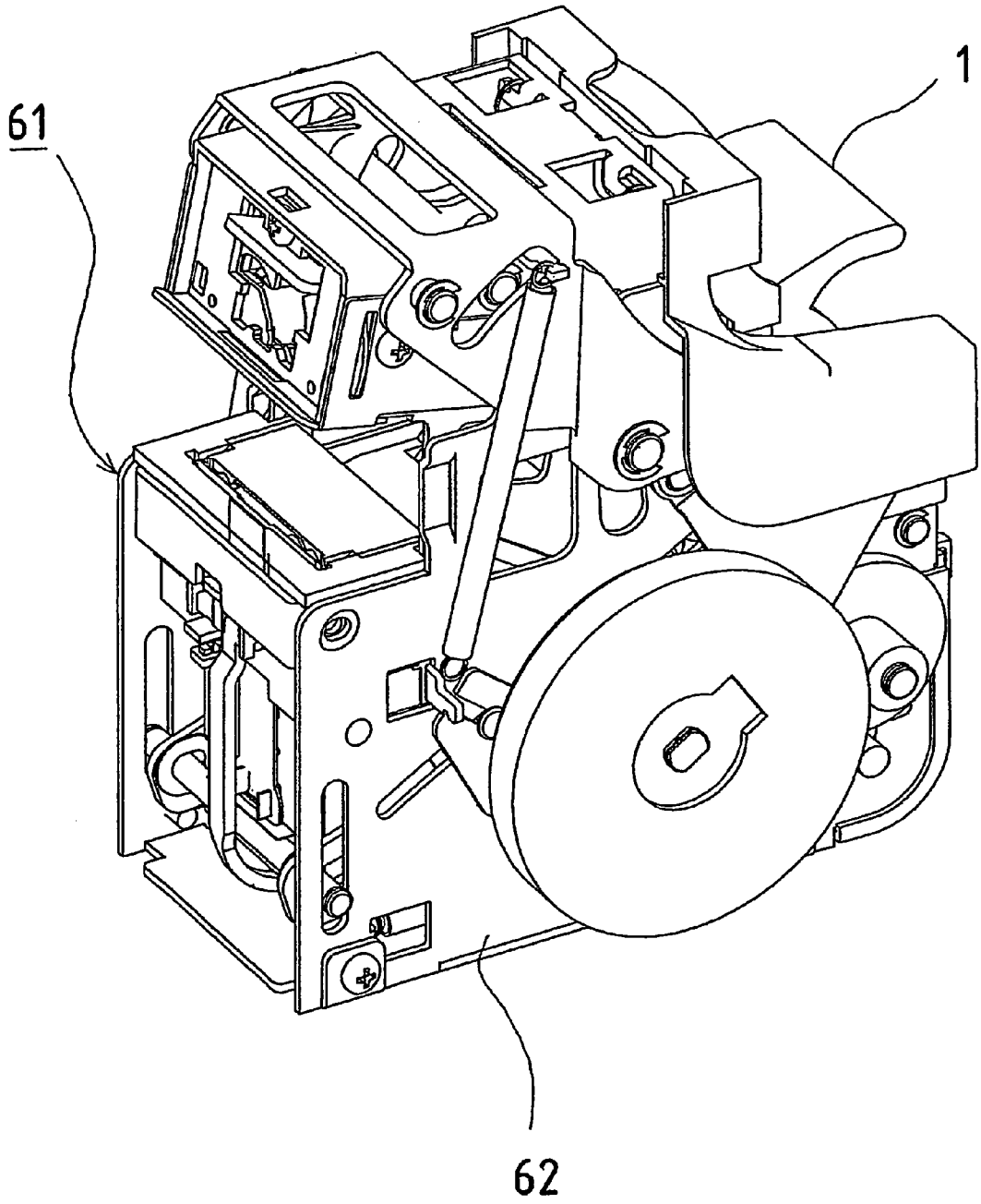
FIG. 7 is a perspective view showing the stapler main body of FIG. 6 when viewed from the other direction.
Figure 8:
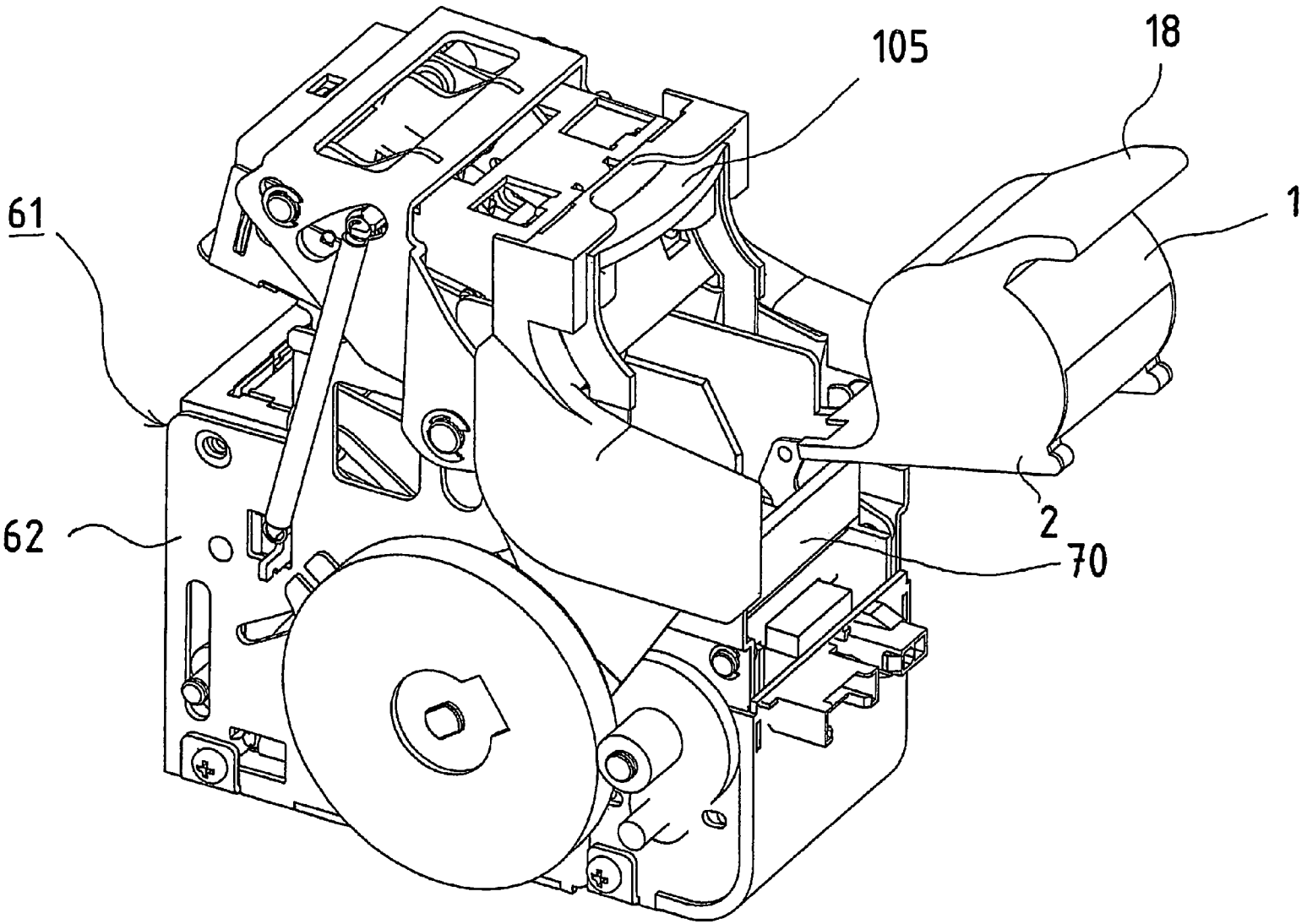
FIG. 8 is a perspective view showing a state in which the staple refill is detached from the stapler main body of FIG. 6.
Figure 9:
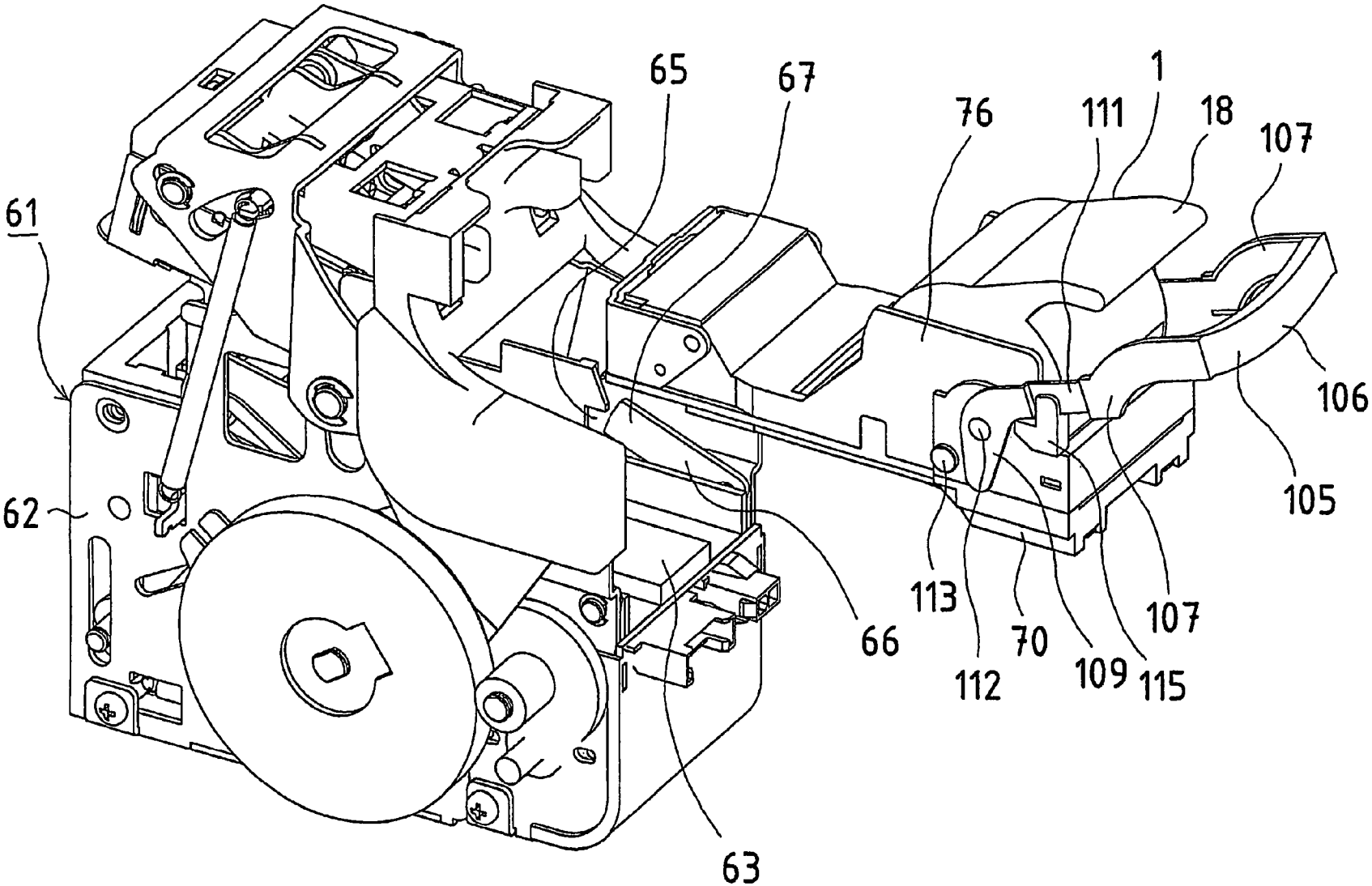
FIG. 9 is a perspective view showing a state in which the cartridge is drawn from the stapler main body of FIG. 6.

An embodiment of a cartridge according to the invention will be described below with reference to FIGS. 1 to 9. FIG. 1 is an overall perspective view showing an embodiment of the cartridge according to the invention, FIG. 1A is a perspective view showing the cartridge when viewed from a rear side, and FIG. 1B is a perspective view showing the cartridge when viewed from a front side. FIG. 2 is a set of six drawings showing the cartridge of FIG. 1, FIG. 2A is a top view of the cartridge when viewed from above, FIG. 2B is a side view showing the cartridge when viewed from one side, FIG. 2C a bottom view showing the cartridge when viewed from below, FIG. 2D is a front view showing the cartridge when viewed from a front side, and FIG. 2E is a rear view showing the cartridge when viewed from a rear side. FIG. 3 is an overall perspective view showing a state in which a staple refill is attached to the cartridge of FIG. 1, FIG. 3A is a perspective view showing the state when viewed from a rear side, and FIG. 3B is a perspective view showing the state when viewed from a front side FIG. 4 is an overall perspective view in which a part of the cartridge of FIG. 3 is omitted, FIG. 4A is a perspective view showing the cartridge when viewed from a front side, and FIG. 4B is a perspective view showing the cartridge when viewed from a rear and lower side. FIG. 5 is a set of six drawings showing the cartridge of FIG. 4, FIG. 5A is a top view of the cartridge when viewed from above, FIG. 5B is a side view showing the cartridge when viewed from one side, FIG. 5C a bottom view showing the cartridge when viewed from below, FIG. 5D is a front view showing the cartridge when viewed from a front side, FIG. 5E is a rear view showing the cartridge when viewed from a rear side, and FIG. 5F is a side view explaining an operation of the cartridge. FIG. 6 is a perspective view showing a stapler main body on which the cartridge of FIG. 3 is mounted when viewed from one direction. FIG. 7 is a perspective view showing the stapler main body of FIG. 6 when viewed from the other direction. FIG. 8 is a perspective view showing a state in which the staple refill is detached from the stapler main body of FIG. 6. FIG. 9 is a perspective view showing a state in which the cartridge is drawn from the stapler main body of FIG. 6.

A cartridge 70 is drawably provided in a stapler main body 62. A storage chamber 82, an engaging member 85, and a lock member 95 are provided in a cartridge main body 70A. A staple refill 1 is detachably stored in the storage chamber 82, the engaging member 85 engages one side of the staple refill 1 stored in the storage chamber 82, and the lock member 95 locks the engaging member 85.

The lock member 95 includes an abutting portion 97 which abuts on a sheet-like connected staple S, discharged from a discharge port 46 of the staple refill 1, when the staple refill 1 is stored in the storage chamber 82. When the abutting portion 97 abuts on the sheet-like connected staple S, the lock member 95 locks the engaging member 85 to prevent disengagement of the staple refill 1. When the abutting portion 97 does not abut on the sheet-like connected staple S, the lock member 95 unlocks the engaging member 85 to enable the staple refill 1 to be disengaged.

The lock member 95 is oscillatably provided in the cartridge main body 70A. The abutting portion 97 is formed at one end and a latch portion 98 is formed at the other end. The abutting portion 97 emerges to the inside of the storage chamber 82 to abut on the sheet-like connected staple S through a through-hole 74 formed in the cartridge main body 70A. In the latch portion 98, when the abutting portion 97 abuts on the sheet-like connected staple S, the lock member 95 oscillates in a latch direction of the latch portion 98 to latch the engaging member 85. When the abutting portion 97 does not abut on the sheet-like connected staple S, the lock member 95 oscillates in an unlatch direction of the latch portion 98 to unlatch the engaging member 85.

The cartridge 70 includes the storage chamber 82, the engaging member 85, and the lock member 95. The storage chamber 82 is attached to a stapler 61 which binds sheets of paper with a staple, and the staple refill 1 in which the staple is accommodated is detachably stored in the storage chamber 82. The engaging member 85 engages the staple refill 1 stored in the storage chamber 82 to prevent the disengagement from the storage chamber 82. The lock member 95 latches the engaging member 85 to prevent the release between the staple refill 1 and the engaging member 85. The lock member 95 includes the abutting portion 97 which abuts on the staple accommodated in the staple refill 1. The engaging member 85 is latched by the abutment between the abutting portion 97 and the staple in the staple refill 1, which prevents the release of the engagement between the engaging member 85 and the staple refill 1.

Figure 10:
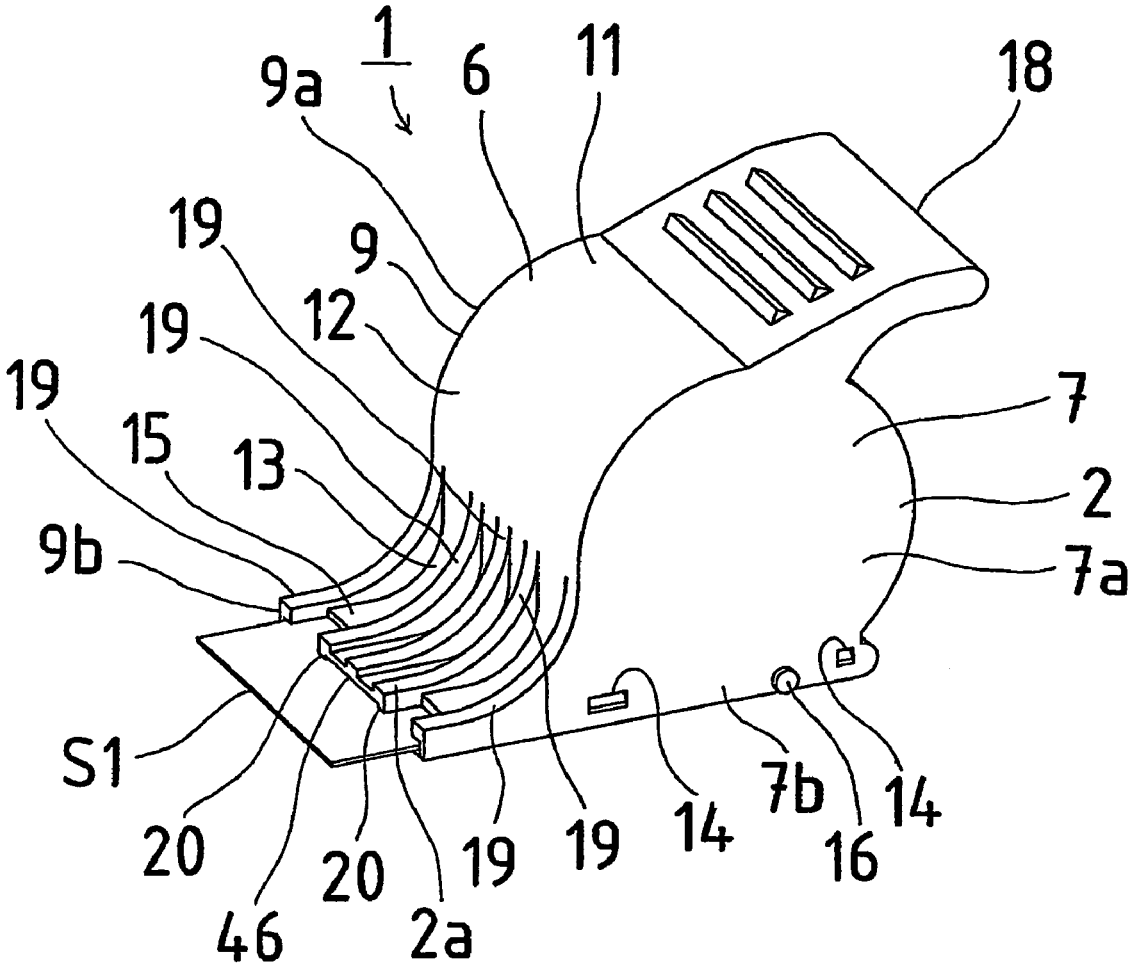
FIG. 10 is an overall perspective view showing an embodiment of a staple refill.
Figure 11:
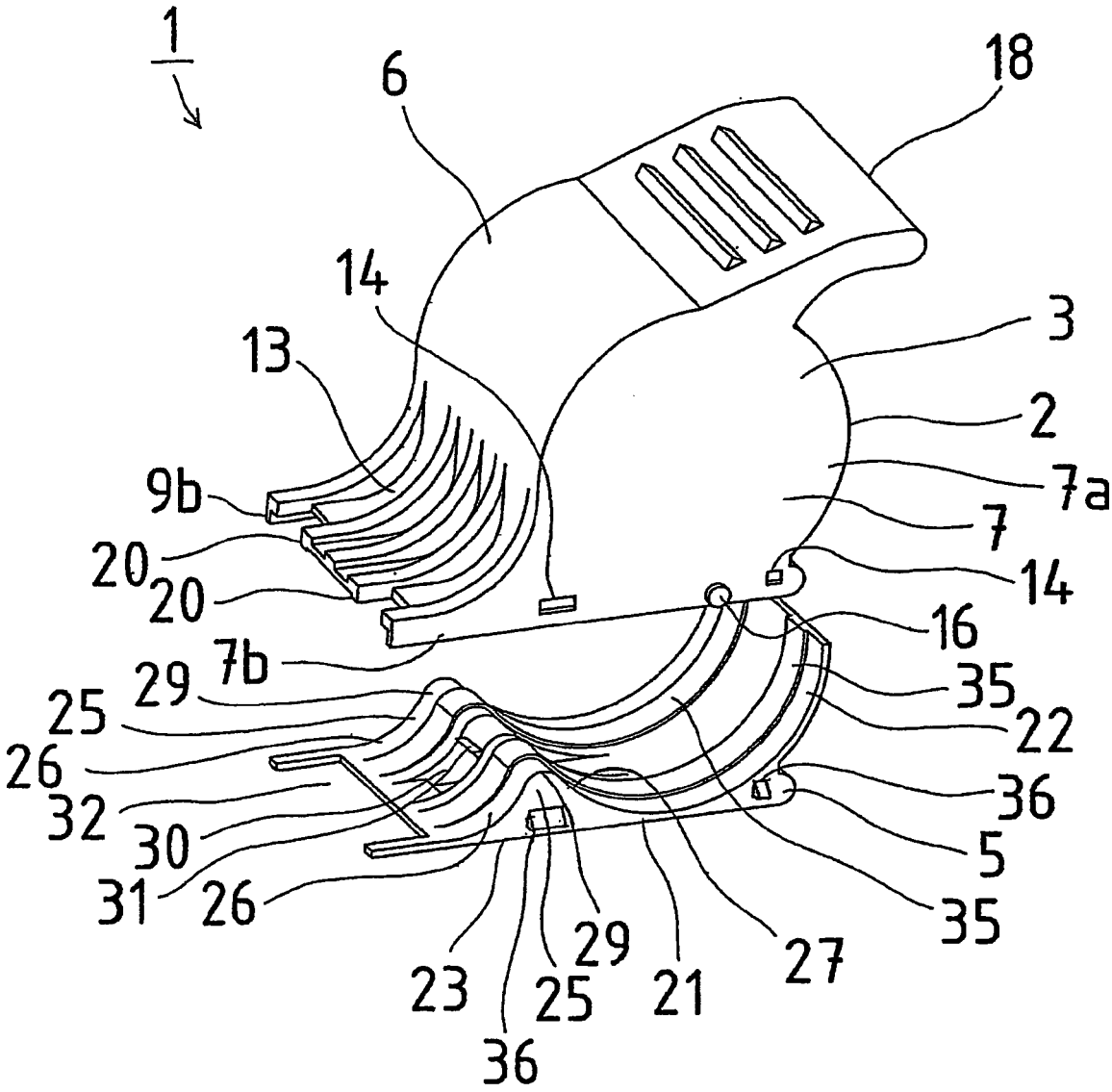
FIG. 11 is an exploded perspective view of FIG. 10.
Figure 12:
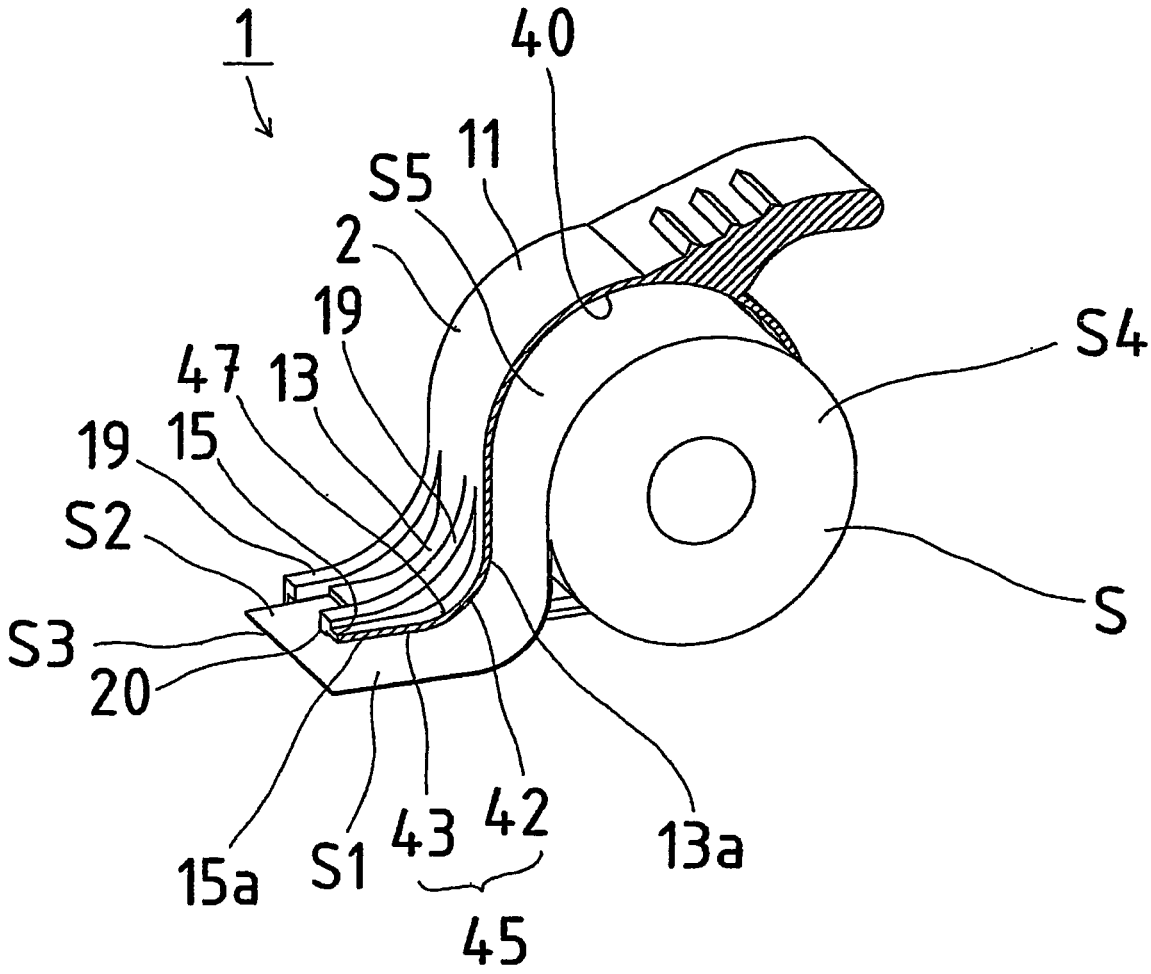
FIG. 12 is a sectional perspective view of FIG. 10.
Figure 13:
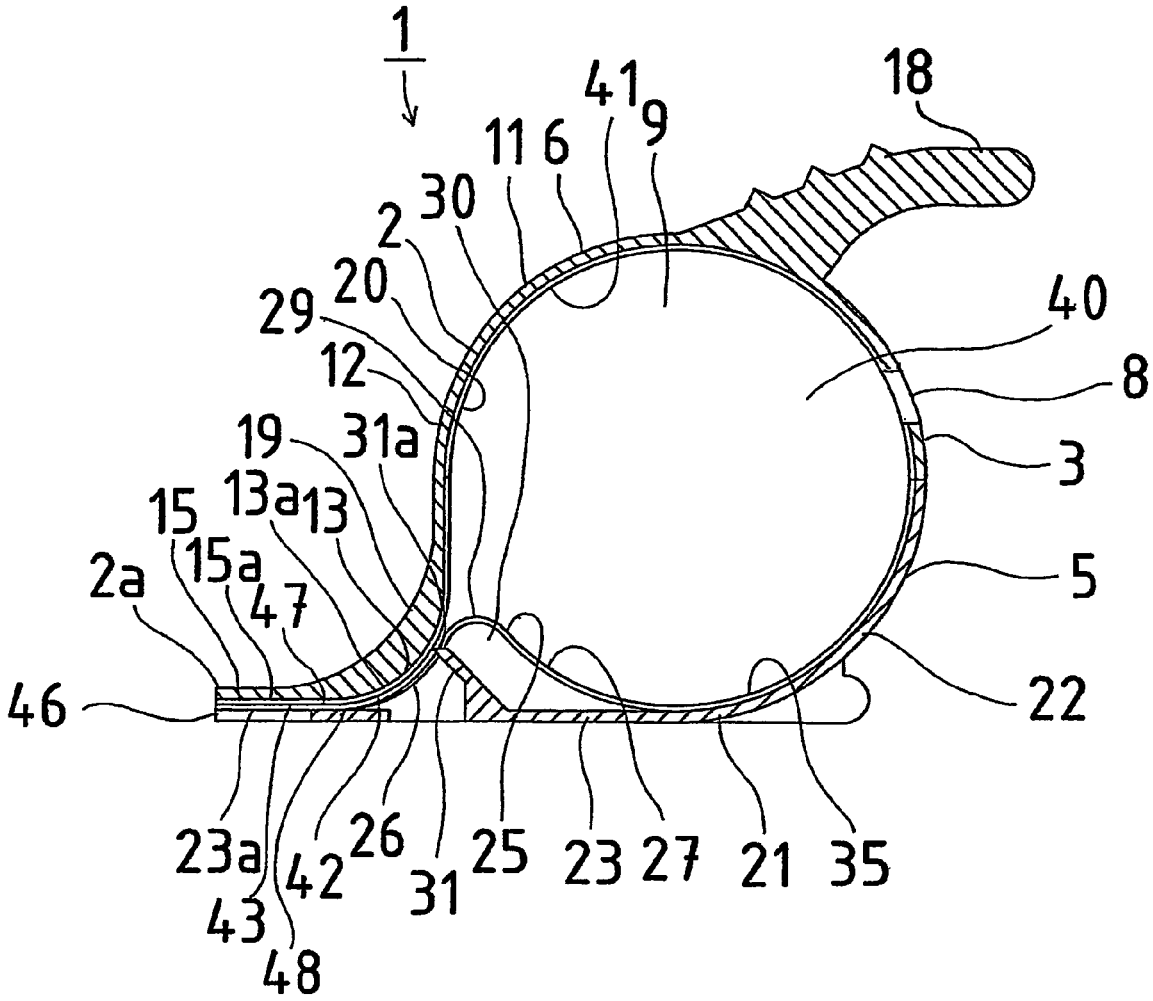
FIG. 13 is a sectional side view of FIG. 10.
Figure 14:
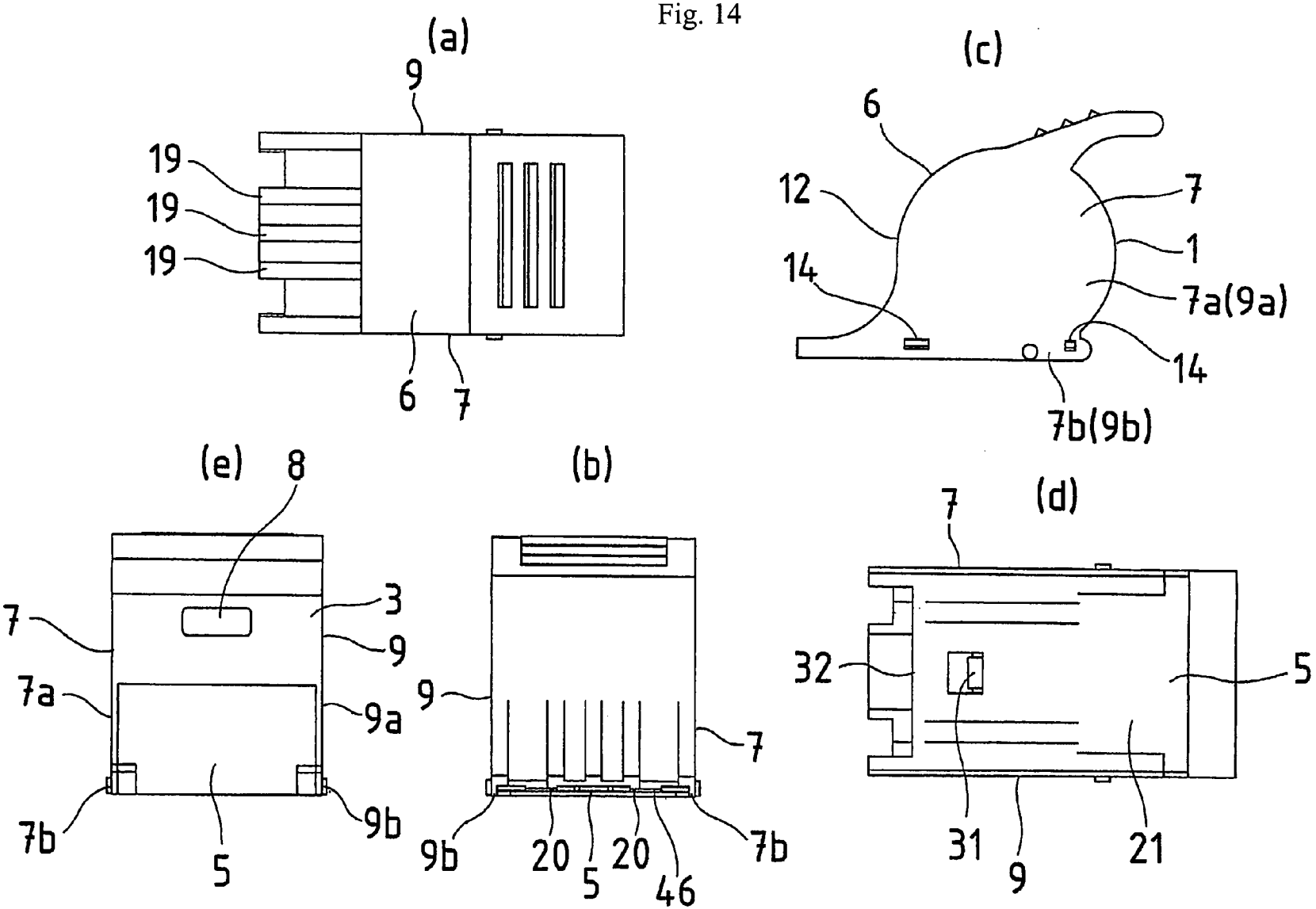
FIG. 14 is a set of six drawings showing the staple refill of FIG. 10.
Figure 15:
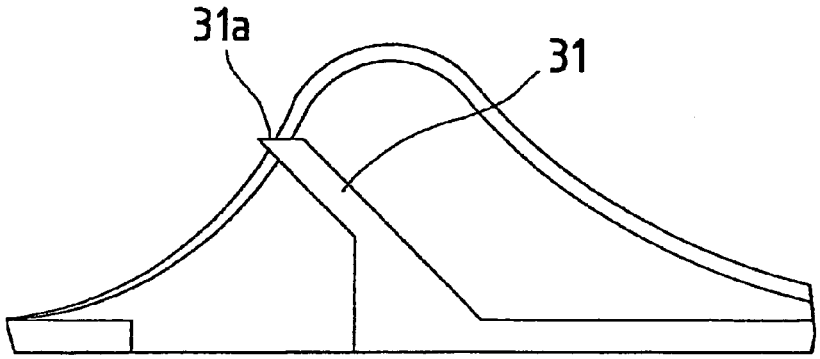
FIG. 15 is a sectional view showing a main part of FIG. 10.
Figure 15:
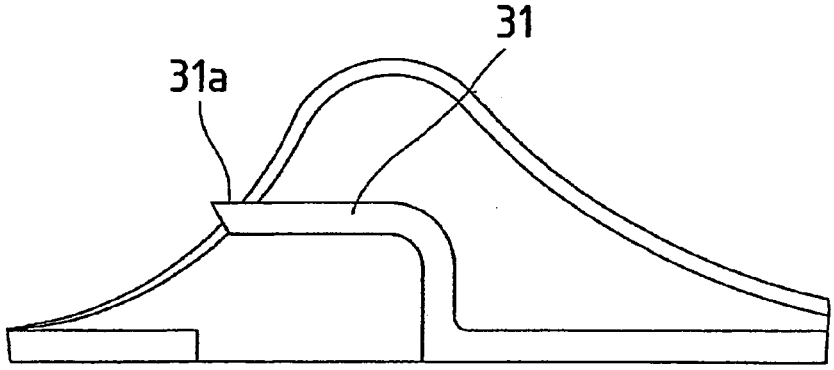
Figure 15:
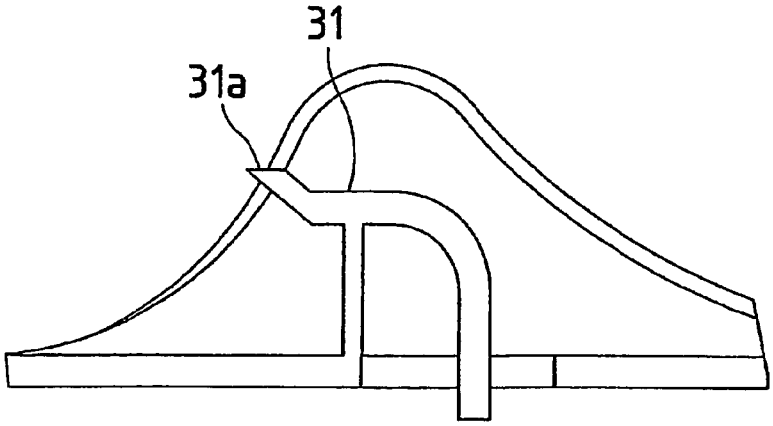
Figure 16:
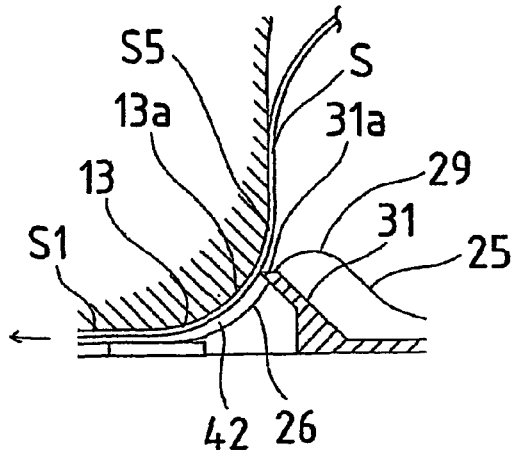
FIG. 16 is an explanatory view showing an operation of the staple refill.
Figure 16:
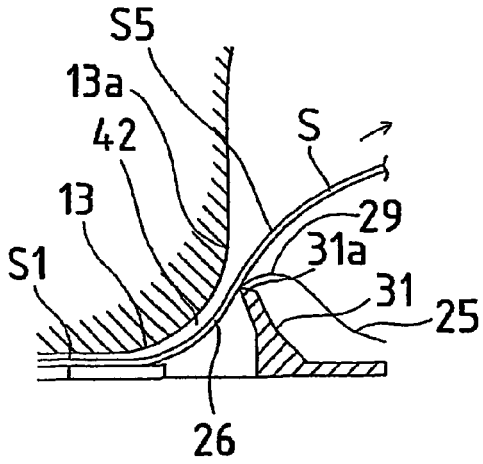
Figure 16:
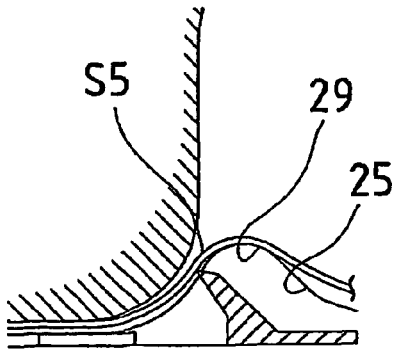
Figure 17:
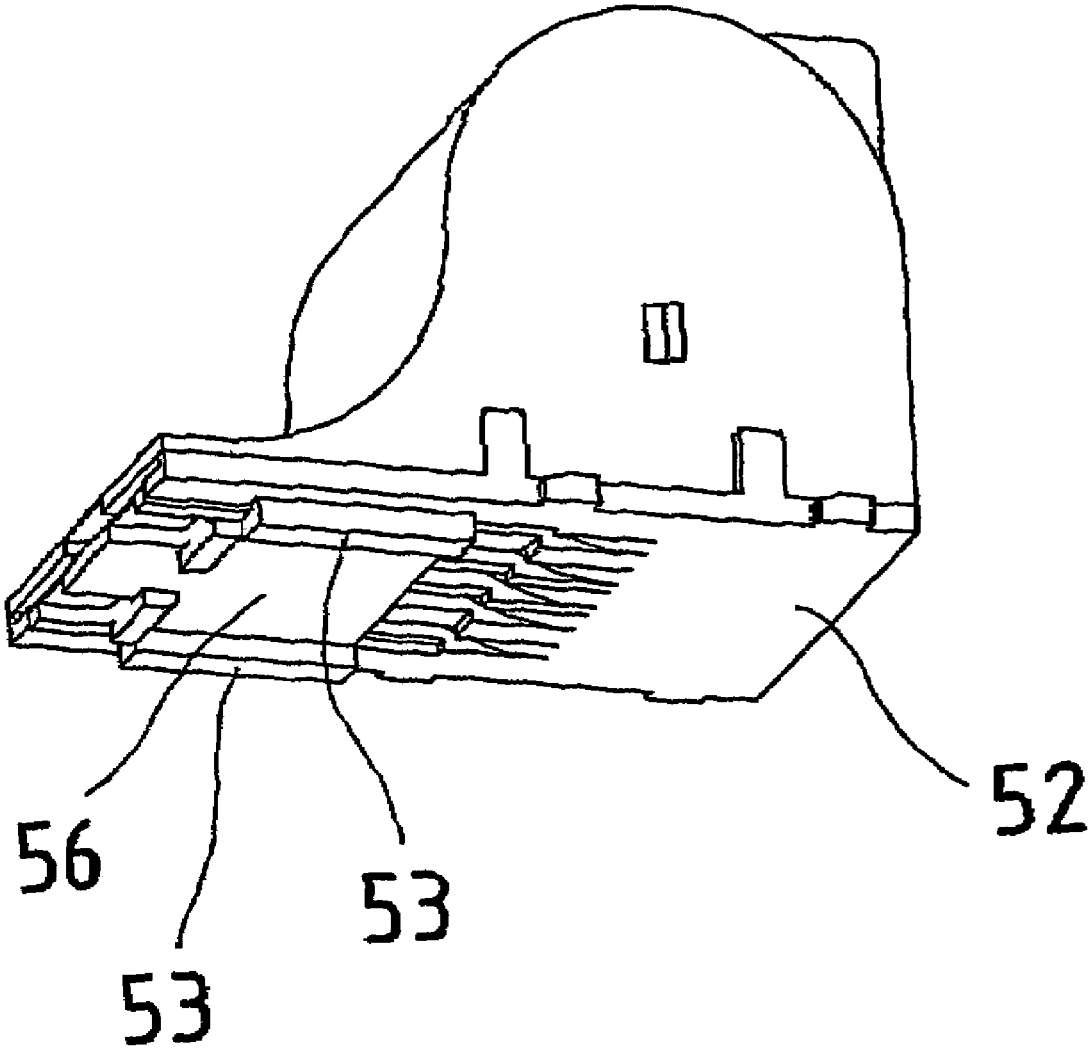
FIG. 17 is an overall perspective view showing another embodiment of a staple refill.
Figure 18:
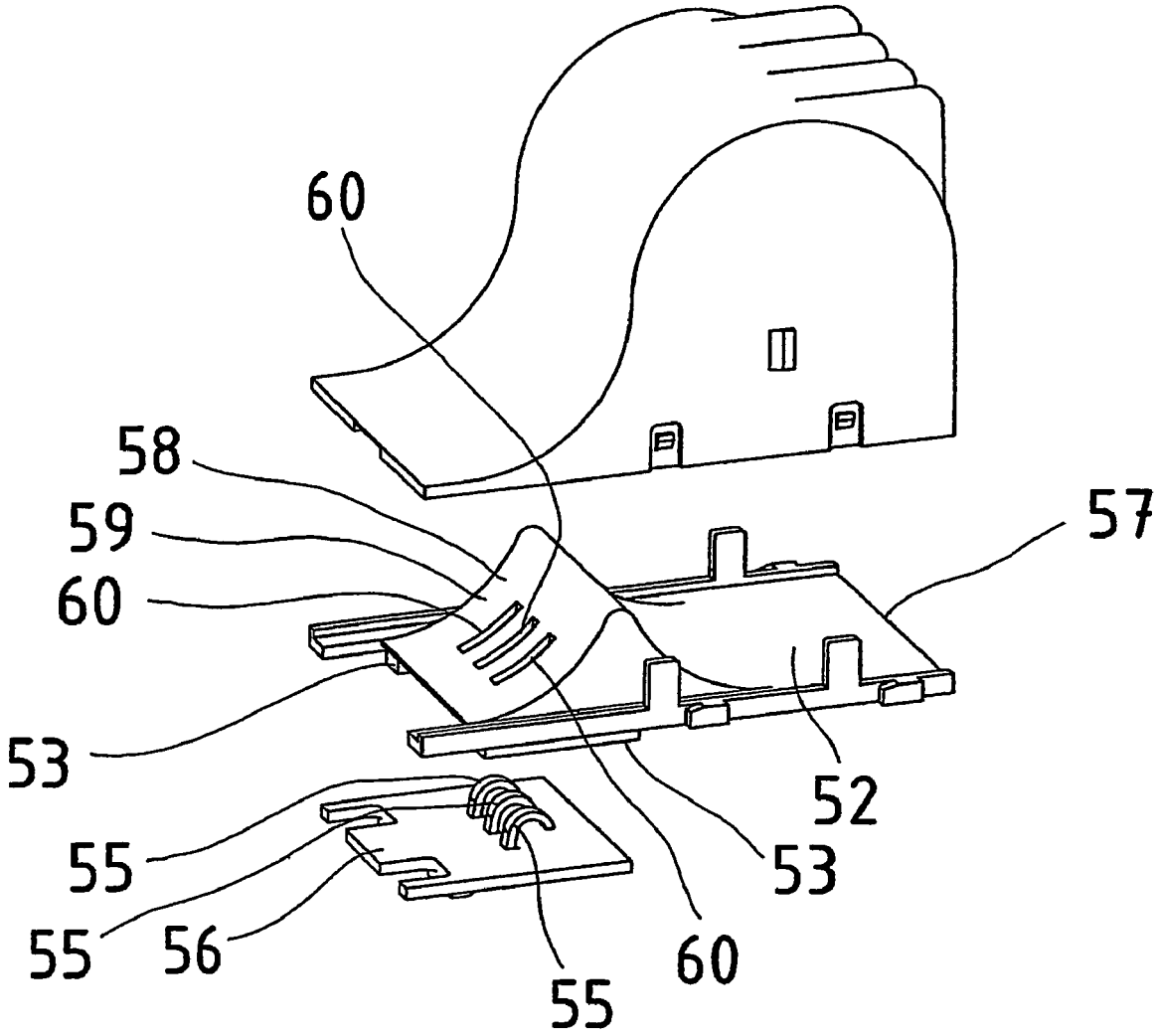
FIG. 18 is an exploded perspective view of FIG. 17.

The staple refill stored in the cartridge and the stapler main body in which the cartridge is drawably provided will be described before the detailed description of the cartridge. FIG. 10 is an overall perspective view showing an embodiment of a staple refill. FIG. 11 is an exploded perspective view of FIG. 10. FIG. 12 is a sectional perspective view of FIG. 10. FIG. 13 is a sectional side view of FIG. 10. FIG. 14 is a set of six drawings showing the staple refill of FIG. 10. FIG. 15 is a sectional view showing a main part of FIG. 10. FIG. 16 is an explanatory view showing an operation of the staple refill. FIG. 17 is an overall perspective view showing another embodiment of a staple refill. FIG. 18 is an exploded perspective view of FIG. 17.

The staple refill 1 is detachably attached to the cartridge 70 provided in the stapler main body 62. As shown in FIGS. 12 and 13, a refill main body 2 of the staple refill 1 includes a storage portion 40, the discharge port 46, and a delivery passage 45. The sheet-like connected staple S wound in a roll shape is stored in the storage portion 40. The discharge port 46 discharges the sheet-like connected staple S stored in the storage portion 40. The delivery passage 45 delivers a leading end portion S1 of the sheet-like connected staple S stored in the storage portion 40 to the discharge port 46.

The delivery passage 45 is curved upward from the discharge port 46 toward the inside of the storage portion 40 so as to deliver the leading end portion S1, located on the upper side of the sheet-like connected staple S, to the discharge port 46. A backward movement preventing member 31 which prevents the sheet-like connected staple S from moving toward the reverse side of the discharge port 46 (toward the side of storage portion 40) is provided in the delivery passage 45. The backward movement preventing member 31 is integrated with refill main body 2.

The backward movement preventing member 31 is formed such that a leading edge 31*a* slides on the side of a lower surface S3 of the sheet-like connected staple S to latch a connecting recess portion between the staples. The delivery passage 45 includes a first guide passage 43 and a second guide passage 42. The first guide passage 43 substantially formed in a linear shape is communicated with the discharge port 46. The second guide passage 42 curved upward is communicated with the storage portion 40. The backward movement preventing member 31 is provided in the second guide passage 42 while being exposed.

The delivery passage 45 includes an upper guide surface 47 and a lower guide surface 48. The upper guide surface 47 guides an upper surface S2 of the sheet-like connected staple S, and the lower guide surface 48 guides the lower surface S3 of the sheet-like connected staple S. An upper guide surface 13*a* of the second guide passage 42 is coupled to an inner surface 41 of the storage portion 40. A lower guide surface of the second guide passage 42 is formed by curved one surface 26 (on the side of the discharge port 46) of a guide projection portion 25 projected into the storage portion 40. The backward movement preventing member 31 is formed so as to be projected from one surface 26 (on the side of the discharge port 46) of the guide projection portion 25. The other surface 27 (on the side of the storage portion 40) of the guide projection portion 25 is curved so as to guide the sheet-like connected staple S stored in the storage portion 40.

Projection strips 20 and 35 are provided in the inner surface of the storage portion 40 of the refill main body 2. The projection strips 20 and 35 slide on the outer surface of the sheet-like connected staple S wound in a roll shape, and smoothly rotate the sheet-like connected staple S. An opening 8 communicated with the storage portion 40 is formed in the refill main body 2. Further, the staple refill will be described in detail. As shown in FIGS. 10 and 11, the refill main body 2 of the staple refill 1 includes an upper case 3 and a lower case 5 which is detachably fixed to the upper case 3. The upper case 3 is integrally formed by a synthetic resin, and includes an upper wall 6, a left wall 7 provided in the left end of the upper wall 6, and a right wall 9 provided in the right end of the upper wall 6.

The upper wall 6 includes an upper semi-cylindrical wall 11, a vertical wall 12 whose upper end is coupled to a front end of the upper semi-cylindrical wall 11, a curved wall 13 whose one end is coupled to a lower end of the vertical wall 12, and a horizontal wall 15 whose rear end is coupled to the other end of the curved wall 13. The left wall 7 and the right wall 9 include circular walls 7*a* and 9*a* and lower walls 7*b* and 9*b* respectively. The lower walls 7*b* and 9*b* extending in a substantially horizontal direction are coupled to lower ends of the circular walls 7*a* and 9*a*, respectively. The lower walls 7*b* and 9*b* are projected downward from the horizontal wall 15. Latch holes 14 and 14 are formed in the lower walls 7*b* and 9*b*. Further, an engaging shaft 16 is formed near the latch hole 14 in the rear side in the lower walls 7*b* and 9*b*.

A grip arm 18 extending backward is formed in the upper portion of the upper semi-cylindrical wall 11. A rib 19 reinforcing the curved wall 13 is formed in the upper surface of the curved wall 13. The opening 8 is formed in the rear portion of the upper semi-cylindrical wall 11. Further, the guide projection strip 20 guiding the sheet-like connected staple S is provided in the inner surface of the upper wall 6 of the upper case 3, i.e., in the inner surfaces of the upper semi-cylindrical wall 11, the vertical wall 12, the curved wall 13, and the horizontal wall 15.

As shown in FIGS. 12 and 13, similarly to the upper case 3, the lower case 5 is integrally formed by a synthetic resin, and includes a lower wall 21. The lower wall 21 includes an arc wall 22 and a linear wall 23. The arc wall 22 is formed in a substantially quarter arc shape, and the rear end of the linear wall 23 is coupled to the front end of the arc wall 22. The mound-shaped guide projection 25 is formed in the linear wall 23. One surface 26 (on the side of the discharge port 46) of the guide projection (guide projection portion) 25 is curved such that a substantially constant gap is formed with the lower surface 13*a* of the curved wall 13 of the upper case 3. The other surface 27 (on the side of the storage portion 40) of the guide projection 25 is curved so as to form the arc like the arc wall 22. A top portion 29 of the guide projection 25 is formed in a semi-circular shape.

A notch portion 30 is formed in a substantially intermediate portion of the guide projection 25. The pawl-shaped backward movement preventing member 31 is integrally provided in the linear wall 23. The backward movement preventing member 31 is located in the notch portion 30, and is projected from the curved one surface 26. In the linear wall 23, a substantially U-shaped notch recessed portion 32 is formed in the front portion, and the rear portion is formed so as to extend beyond the arc wall 22. The guide band (projection strip) 35 guiding the sheet-like connected staple S is projected in the inner surface of the lower wall 21 of the lower case 5, i.e., in the inner surfaces of the arc wall 22, the guide projection 25, and the linear wall 23. Latch pawls 36 and 36 are formed on both sides of the lower wall 21, and are detachably latched in the latch holes 14 and 14 of the upper case 3.

In the staple refill 1, when the lower case 5 is fitted between the lower wall 7*b* of the left wall 7 and the lower wall 9*b* of the right wall 9 of the upper case 3, the latch pawls 36 and 36 of the lower case 5 are latched in the latch holes 14 and 14 of the upper case 3 to assemble the refill main body 2. In the assembly, as shown in FIG. 12, the sheet-like connected staple S is placed in the lower case 5, when the sheet-like connected staple S is stored in the upper case 3 such that the leading end portion S1 of the sheet-like connected staple S wound counterclockwise is located in the upper portion of the upper case 3. In the refill main body 2, the cylindrical storage chamber 40 is formed by the upper semi-cylindrical wall 11 and vertical wall 12 of the upper wall 6, the arc wall 22 and the other surface (on the side of the storage portion 40) 27 of the guide projection (guide projection portion) 25 of the lower case 5, and the left wall 7 and right wall 9. The sheet-like connected staple S is positioned on the lowest linear wall 23 by the arc wall 22 of the lower case 5 and the other surface 27 of the guide projection 25.

In the refill main body 2, the second guide passage 42, which is curved smoothly upward, is formed by the lower surface 13*a* of the curved wall 13 of the upper case 3, one surface (on the side of the discharge port 46) 26 of the guide projection 25 of the lower case 5, and the left wall 7 and right wall 9. The second guide passage 42 is upwardly curved toward the side of the storage portion 40, and is communicated with the storage portion 40. In the refill main body 2, the substantially linear first guide passage 43 is formed by a lower surface 15*a* of the horizontal wall 15 of the upper case 3, an upper surface 23*a* of the linear wall 23 of the lower case 5, and the left wall 7 and right wall 9. That is, the delivery passage 45 is formed by the first guide passage 43 and the second guide passage 42. The discharge port 46 is formed at the front end of the delivery passage 45, and the sheet-like connected staple S is sequentially discharged from the leading end portion S1.

The delivery passage 45 includes the upper guide surface 47 guiding the upper surface S2 of the sheet-like connected staple S and the lower guide surface 48 guiding the lower surface S3 of the sheet-like connected staple S. The upper guide surface 47 is formed by the lower surface 15*a* of the horizontal wall 15 of the upper case 3 and the lower surface 13*a* of the curved wall 13 of the upper case 3. The lower guide surface 48 is formed by the upper surface 23*a* of the linear wall 23 of the lower case 5 and one surface (on the side of the discharge port 46) 26 of the guide projection 25. In the upper guide surface 47 of the delivery passage 45, the two guide projection strips 20 are provided along a moving direction of the sheet-like connected staple S. The guide projection strip 20 is a strip-shaped projection portion which is slightly projected from the upper guide surface 47 toward the side of the sheet-like connected staple S. The guide projection strip 20 reduces a contact area between the upper guide surface 47 and the sheet-like connected staple S to decrease slide resistance in moving the sheet-like connected staple S, and thereby the sheet-like connected staple S is smoothly drawn forth. The notch recessed portion 32 is provided at a position facing the horizontal wall 15 of the upper guide surface 47 of the lower guide surface 48. The notch recessed portion 32 is a portion which brings a feeding pawl (feeding roller) of the stapler main body 50 into contact with the lower surface S3 of the sheet-like connected staple S. The sheet-like connected staple S is drawn from the storage portion 40 by the notch recessed portion 32, and the sheet-like connected staple S is fed to the discharge port 46. The backward movement preventing member 31 is projected toward the inside of the second guide passage 42, and the leading edge 31*a* extends to a neighborhood of the lower surface 13*a* of the curved wall 13. The backward movement preventing member 31 can be bent due to elasticity of the synthetic resin material. The leading edge 31*a* of the backward movement preventing member 31 slides on the lower surface S3 of the sheet-like connected staple S to latch the connecting recess portion between the staples of the sheet-like connected staple S, which prevents the backward movement of the sheet-like connected staple S to the side of the storage portion 40. The shape of the backward movement preventing member 31 is not particularly limited. For example, the backward movement preventing member 31 can obliquely be provided as shown in FIG. 15A, the backward movement preventing member 31 can be provided in a substantially L-shape as shown in FIG. 15B, and the backward movement preventing member 31 can be provided in a substantially n-shape as shown in FIG. 15C. As described above, the backward movement preventing member 31 is formed in a pawl shape, and the leading edge 31*a* strongly presses the sheet-like connected staple S (particularly drawn-forth portion S5) against the side of the lower surface 13*a* of the curved wall 13 during transportation. Therefore, there is no possibility that the sheet-like connected staple S is drawn from the staple refill 1 due to the excessive shock or the like. In the case where the staple refill 1 is set, the portion projected from the lower wall 21 is returned into the refill, which rotates the backward movement preventing member 31 counterclockwise. The rotation displacement slightly retreats the leading edge 31*a* of the backward movement preventing member 31 from the lower surface 13*a* of the curved wall 13 to decrease the pressing force to the sheet-like connected staple S. Therefore, moving resistance of the sheet-like connected staple S toward the feeding direction is decreased to perform the staple feeding more smoothly. The staple refill 1, in which the leading end portion S1 of the sheet-like connected staple S is previously drawn to the discharge port 46, is usually used. However, in the staple refill 1 in which the leading end portion S1 is not previously drawn from the discharge port 46, a drawing-forth tape (not shown) provided in the leading end portion S1 of the sheet-like connected staple S is drawn from the discharge port 46. When the drawing-forth tape is pulled, the sheet-like connected staple S provided in the storage chamber 40 of the staple refill 1 is rotated and the leading edge of the drawing-forth tape is positioned at the discharge port 46. The staple refill 1 is attached to the cartridge 70 which is detachably mounted to the stapler main body 62, and the cartridge 70 is amounted to the stapler main body 62. When the stapler main body 62 is driven, the leading end portion S1 of the sheet-like connected staple S is intermittently drawn toward the driver side by feeding means (for example, feeding pawl and feeding roller). A roll winding portion S4 of the sheet-like connected staple S is not placed on a drawn-forth portion S5, so that a load applied onto the feeding means is decreased. The whole outer surfaces of the roll winding portion S4 of the sheet-like connected staple S do not come into contact with the inner surface of the storage chamber (storage portion) 40, but a part of the roll winding portion S4 comes into contact with the guide projection strip 20 and/or the guide band (projection strip) 35, so that the contact area becomes small. Therefore, frictional resistance is reduced to further decrease the load applied onto the feeding means.

When the leading end portion S1 of the sheet-like connected staple S is drawn forth by feeding means 100 of the stapler main body 62, as shown in FIG. 16A, the drawn-forth portion S5 is brought into close contact with the upper guide surface (the lower surface 13*a* of the curved wall 13) of the delivery passage 45, and the leading edge 31*a* of the backward movement preventing member 31 slides slightly on the drawn-forth portion S5 of the sheet-like connected staple S. Therefore, the sheet-like connected staple S can securely be delivered while little load is applied onto the feeding means. When the leading end portion S1 of the sheet-like connected staple S is drawn back by a weight of the roll winding portion S4 in the storage portion 40, as shown in FIG. 16B, the drawn-forth portion S5 comes into close contact with one surface 26 of the guide projection 25, and the leading edge 31*a*, projected from one surface 26, of the backward movement preventing member 31 securely latches the sheet-like connected staple S.

In the staple refill 1, the roll winding portion S4 is decreased as the sheet-like connected staple S is drawn forth. As shown in FIG. 16C, the sheet-like connected staple S is delivered to the delivery passage 45 after the drawn-forth portion S5 of the sheet-like connected staple S is lifted by the top portion 29 of the guide projection 25, so that the staple refill 1 also functions in the same manner described above. The top portion 29 of the guide projection 25 is formed in a semi-circular shape, so that the guide projection 25 can smoothly guide the sheet-like connected staple S.

Thus, the staple refill 1 can store the sheet-like connected staple S wound in a roll shape in the storage portion 40 of the refill main body 2 while the leading end portion S1 is placed in the upper portion of the storage portion 40, and the roll winding portion S4 is not placed on the drawn-forth portion S5 when the sheet-like connected staple S is fed from the discharge port 46. Therefore, the load applied onto the feeding means is decreased.

In the conventional staple refill, a backward movement preventing member slides on a linearly extended portion of the sheet-like connected staple, and it is difficult to adjust the contact pressure of the backward movement preventing member in the slide. On the contrary, in the staple refill 1, since the drawing-forth of the sheet-like connected staple is caused to differ from the drawing-back of the sheet-like connected staple in the latching force of the backward movement preventing member 31 by utilizing the curved delivery passage 45 as described above, the latching force of the backward movement preventing member 31 is increased in drawing back the sheet-like connected staple rather than in drawing forth the sheet-like connected staple. Therefore, it is not necessary to adjust the contact pressure of the backward movement preventing member 31.

In the staple refill 1, similarly to the feeding means of the stapler main body 62, the backward movement preventing member 31 is pressed to engage the lower surface S3 of the sheet-like connected staple S, where a bonding agent is not applied and a bonding tape does not adhere in a lengthwise direction. Therefore, the backward movement of the sheet-like connected staple S can securely be prevented, and the backward movement preventing member 31 can be arranged substantially in the center of the lower surface S3, so that the sheet-like connected staple S can be latched in a well-balanced manner. In the staple refill 1, since the backward movement preventing member 31 is integrally formed, it is not necessary to install the backward movement preventing member made of a metal material in the refill main body unlike the conventional staple refill. Therefore, the assembly of the staple refill 1 can easily be performed, and weight reduction and cost reduction of the refill main body 2 can be achieved. Disposal of the staple refill 1 is easy to perform because it is not necessary to separate the staple refill 1 into each material. In the refill main body 2, since the opening 8 is formed in the rear portion of the upper semi-cylindrical wall 11 as described above, the sheet-like connected staple S stored in the storage chamber 40 can be fixed so as not to move during the transportation by mounting a pressing member such as a cushion material from the opening 8 in packaging the staple refill 1, which allow the leading edge position of the sheet-like connected staple S not to be shifted. In the usage of the staple refill 1, a state such as a remaining amount of sheet-like connected staple S can also be confirmed by utilizing the opening 8.

In the staple refill 1, the backward movement preventing member 31 is integrated with the lower wall 21 of the lower case 5. Alternatively, as shown in FIGS. 17 and 18, substantially L-shaped engaging projections 53 and 53 are formed on both sides of a plate-shaped lower wall 52 of a lower case 57, both ends of an insertion plate 56 including backward movement preventing members 55, which are formed substantially in an inverse U-shape and separately formed by a synthetic resin, are engaged to the engaging projections 53 and 53, and the backward movement preventing member 55 may be provided in the lower wall 52 of the lower case 57. The backward movement preventing members 55 which are formed substantially in an inverse U-shape are projected from long holes 60 formed in curved one surface 59 of a substantially mound-shaped guide projection 58, and press the sheet-like connected staple S.

The stapler main body 62 of the stapler 61 is attached to a motor-driven stapler, a copying machine, and the like. As shown in FIG. 9, a cartridge storage portion 63 is formed, and the cartridge 70 is drawably provided in the cartridge storage portion 63. Engaging recessed portions 65 and 65 which are opened backward are formed on both sides of the cartridge storage portion 63. Arm members 66 and 66 biased clockwise by elastic members (not shown) are provided on both sides of the cartridge storage portion 63, and the engaging recessed portion 65 and 65 are closed by leading end portions 67 and 67 of the arm members 66 and 66.

In the stapler main body 62, a forming plate and an extruding driver are arranged in the front portion of the cartridge storage portion 63. The forming plate forms the linear staple located at the leading edge of the sheet-like connected staple S in a U-shape, and the extruding driver extrudes the staple deformed in a U-shape. A driving device which intermittently feeds the sheet-like connected staple S onto the driver side is provided in the lower portion of the cartridge storage portion 63.

As shown in FIGS. 1 and 2, the cartridge main body 70A of the cartridge 70 includes a bottom plate 71, a right guide plate 72 provided in a right-end front portion of the bottom plate 71, a right side plate 73 provided in a right-end rear portion of the bottom plate 71, a left guide plate 75 provided in a left-end front portion of the bottom plate 71, a left side plate 76 provided in a left-end rear portion of the bottom plate 71, a substantially U-shaped rear plate 77 provided in the rear end of the bottom plate 71, and a substantially U-shaped front plate 79 provided in the front end of the bottom plate 71. In the cartridge main body 70A, the storage chamber 82 whose upper portion is opened is formed by the bottom plate 71, the right guide plate 72, the right side plate 73, the left guide plate 75, the left side plate 76, the rear plate 77, and the front plate 79.

As shown in FIG. 5, a rectangular opening 78 is formed in the front portion of the bottom plate 71. As shown in FIG. 3, a staple punch-out guide 80 is provided in the front portion of the cartridge 70. A latch portion 81 which latches the front portion 2*a* on the side of the discharge port 46 of the staple refill 1 is formed in the staple punch-out guide 80.

As shown in FIGS. 4 and 5, the engaging member 85 bend in a substantially U-shape and the long and thin lock members 95 and 95 are provided in the cartridge main body 70A. The engaging member 85 includes a movable plate 86, a left engaging plate 87 provided at the left end of the movable plate 86, and a right engaging plate 88 provided at the right end of the movable plate 86. Engaging projections 89 and 89 are formed in the left engaging plate 87 and the right engaging plate 88, respectively. Latch grooves 90 and 90 are formed on both sides of the movable plate 86. The left engaging plate 87 is attached inside the left side plate 76 while being rotatable by a support shaft 91. As shown in FIG. 1, the right engaging plate 88 is attached inside the right side plate 73 while being rotatable by the support shaft 91. The movable plate 86 is located on the backside of the bottom plate 71, and integrally attached to the lower ends of the left engaging plate 87 and right engaging plate 88 which are projected from the openings formed on the both sides of the bottom plate 71. In the engaging member 85, the movable plate 86 is pressed by one end of each of elastic members 92 and 92, and biased in the engaging direction (in the clockwise direction) of the engaging projections 89 and 89.

The lock members 95 and 95 are oscillatably provided on the both sides in the backside of the bottom plate 71 of the cartridge main body 70A by pivots 96 and 96. In the lock member 95, the abutting portion 97 is formed at one end and the latch portion 98 is formed at the other end. The abutting portion 97 emerges to the inside of the storage chamber 82 to abut on the sheet-like connected staple S through the through-hole 74 formed in the bottom plate 71 in the cartridge main body 70A. The through-holes 74 and 74 are formed near the discharge port 46 when the staple refill 1 is stored in the storage chamber 82, and the through-holes 74 and 74 are formed on the both sides of the bottom plate 71. The latch portions 98 and 98 include latch projections 99 and 99 which can be latched in the latch grooves 90 and 90 of the movable plate 86 respectively.

In the lock member 95, the side of the latch portion 98 is heavier than the side of the abutting portion 97. The lock member 95 is biased clockwise about the pivot 96. Accordingly, in the cartridge 70, in an initial state in which the staple refill 1 is not stored in the storage chamber 82, the abutting portion 97 of the lock member 95 is projected to the inside of the storage chamber 82, and the latch projection 99 of the latch portion 98 is separated from the latch groove 90 of the movable plate 86. The feeding means 100 is provided in the backside of the bottom plate 71, and the feeding means 100 includes a feeding pawl which intermittently feeds the sheet-like connected staple S from the opening 78. As shown in FIG. 3, a cover 83 is detachably attached to the backside of the bottom plate 71 by fixing means such as a latch pawl and a screw. The pivot 96 of the lock member 95 is pivoted to the cover 83, and the other end of the elastic member 92 is held by the cover 83.

As described above, the rear plate 77 of the cartridge main body 70A is formed in a substantially U-shape. As shown in FIG. 1, the rear plate 77 includes a rear face plate 77*a*, a left bent plate 77*b* provided at the left end of the rear face plate 77*a*, and a right bent plate 77*c* provided at the right end of the rear face plate 77*a*. The left bent plate 77*b* is bonded to an outer surface of the left side plate 76, and the right bent plate 77*c* is bonded to the outer surface of the right side plate 73. Attachment shafts 112 are formed in the upper portions of the left bent plate 77*b* and right bent plate 77*c*, and guide shafts 113 are provided in the lower front portions of the attachment shafts 112.

As shown in FIG. 9, an operation lever 105 is rotatably attached to the cartridge 70. The operation lever 105 includes a handle portion 106 and arms 107 and 107 provided at both ends of the handle portion 106. The lower portions of the arms 107 and 107 are rotatably attached to the attachment shafts 112 and 112. Bent engaging pieces 109 and 109 are integrally formed in the lower ends of the arms 107 and 107, respectively. Intermediate portions 111 and 111 of the arms 107 and 107 are recessed toward the inside, and the intermediate portions 111 and 111 are latched by substantially L-shaped latch portions 115 and 115 formed in the rear portions of the left side plate 76 and right side plate 73, respectively. When the arms 107 and 107 are latched by the latch portions 115 and 115, the operation lever 105 is not rotated clockwise.

In the cartridge 70 having the above-described configuration, when the staple refill 1 is stored in the storage chamber 82, the front portion 2*a* of the staple refill 1 is latched by the latch portion 81. The engaging shafts 16 and 16 of the staple refill 1 press the engaging projections 89 and 89, formed in the left engaging plate 87 and right engaging plate 88 of the engaging member 85, against the elasticity of the elastic members 92 and 92. When the engaging shafts 16 and 16 climb over the engaging projections 89 and 89, the engaging shafts 16 and 16 are engaged by the engaging projections 89 and 89 returned to the original positions by the elastic members 92 and 92. Thus, the staple refill 1 is fixed in the storage chamber 82 of the cartridge main body 70A. When the cartridge 70 is pressed into the cartridge storage portion 63 of the stapler main body 62 as shown in FIG. 9, the guide shafts 113 and 113 of the cartridge 70 engage the engaging recessed portions 65 and 65 while rotating the arm members 66 and 66 counterclockwise against the elasticity of the elastic member, and the guide shafts 113 and 113 are fixed by the engaging recessed portions 65 and 65 and the leading end portions 67 of the arm members 66 and 66 returned to the original positions. Thus, the cartridge 70 is attached to the stapler main body 62. As shown in FIG. 6, the engaging pieces 109 and 109 engage the arm members 66 and 66 to be rotated counterclockwise as shown in FIG. 6, and the operation lever 105 is held in a substantially vertical state.

When the stapler main body 62 is driven, the sheet-like connected staple S in the refill main body 2 is drawn from the discharge port 46 by the feeding means 100, the leading end portion S1 of the sheet-like connected staple S abuts on the abutting portions 97 and 97 of the lock members 95 and 95. The lock members 95 and 95 are rotated counterclockwise, and the latch projections 99 and 99 of the latch portions 98 and 98 latch the latch grooves 90 and 90 of the movable plate 86 to lock the engaging member 85. Because the left engaging plate 87 and the right engaging plate 88 cannot be rotated, the engaging shafts 16 and 16 of the refill main body 2 are fixed by the engaging projections 89 and 89 formed in the left engaging plate 87 and the right engaging plate 88, and the staple refill 1 cannot be detached from the cartridge 70 in a period during which the sheet-like connected staple S abuts on the abutting portions 97 and 97 of the lock members 95 and 95, i.e., in the period during which the sheet-like connected staple S remains in the refill main body 2.

In the case where all the sheet-like connected staples S are discharged from the refill main body 2, the abutting portions 97 and 97 of the lock members 95 and 95 do not abut on the sheet-like connected staple S, so that the abutting portions 97 and 97 of the lock members 95 and 95 are projected into the storage chamber 82 through the through-holes 74 and 74. The lock members 95 and 95 are rotated clockwise, and the latch projections 99 and 99 of the latch portions 98 and 98 are separated from the latch grooves 90 and 90 of the movable plate 86 to unlock the engaging member 85. The left engaging plate 87 and the right engaging plate 88 can be rotated against the elasticity of the elastic member 92, so that the staple refill 1 can be detached from the cartridge 70. In the case where the staple refill 1 is detached from the cartridge 70, as shown in FIGS. 6 and 8, only the grip arm 18 of the staple refill 1 can be grasped to pull up the staple refill 1 while the cartridge 70 is mounted on the stapler main body 62. As shown in FIG. 4, when the staple refill 1 is pulled up, the engaging shafts 16 and 16 of the refill main body 2 press the engaging projections 89 and 89 formed in the left engaging plate 87 and right engaging plate 88 of the engaging member 85 against the elasticity of the elastic members 92 and 92. The staple refill 1 disengages the cartridge 70 when the engaging shafts 16 and 16 climb over the engaging projections 89 and 89. As shown in FIG. 8, the staple refill 1 can be stored in the storage chamber 82 of the cartridge 70 even if the cartridge 70 is mounted on the stapler main body 62.

As described above, the staple refill 1 cannot be detached from the cartridge 70 when the sheet-like connected staple S remains in the refill main body 2. However, the cartridge 70 can be taken from the stapler main body 62. When the operation lever 105 provided in the cartridge 70 is rotated clockwise, the engaging pieces 109 and 109 counterclockwise press down the arm members 66 and 66 against the elasticity of the elastic member to open the engaging recessed portions 65 and 65. In this state of things, the guide shafts 113 and 113 disengage the engaging recessed portions 65 and 65 by pulling the operation lever 105, which allows the cartridge 70 to be taken from the stapler main body 62.

Thus, in the cartridge 70, the engaging member 85 engages the engaging shaft 16 of the staple refill 1 when the staple refill 1 is stored in the storage chamber 82. When the abutting portion 97 of the lock member 95 abuts on the sheet-like connected staple S discharged from the discharge port 46 of the staple refill 1, the lock member 95 locks the engaging member 85 to hold the engaging state, and the release of the staple refill 1 is prevented. When all the sheet-like connected staples S of the staple refill 1 are discharged, since the abutting portion 97 does not abut on the sheet-like connected staple S, the lock member 95 unlocks the engaging member 85 to enable the release of the staple refill 1. In the cartridge 70, the staple refill 1 cannot be detached unless all the sheet-like connected staples S of the staple refill 1 are discharged, so that the breakage of the sheet-like connected staple S can be prevented. As a result, the obstacle such as the clogging caused by the breakage can be eliminated.

EFFECTS OF THE INVENTION

In the cartridge according to the invention, when the staple refill is stored in the storage chamber, the engaging member engages one side of the staple refill. When the sheet-like connected staple is discharged from the discharge port of the staple refill by the feeding means of the stapler, because the abutting portion of the lock member abuts on the sheet-like connected staple discharged, the lock member locks the engaging member to hold the engaging state of the engaging member, which prevents the release of the staple refill. When all the sheet-like connected staples are discharged from the staple refill, because the abutting portion of the lock member does not abut on the sheet-like connected staple, the lock member unlocks the engaging member to enable the release of the staple refill. Thus, in the cartridge according to the invention, the staple refill cannot be detached unless all the sheet-like connected staples are discharged from the staple refill, so that the breakage of the sheet-like connected staple can be prevented. As a result, the cartridge according to the invention has the effect that the obstacle such as the clogging caused by the breakage can be eliminated.

In the cartridge according to the invention, the lock member is oscillatably provided in the cartridge main body. When one of abutting portions of the lock member emerges into the storage chamber to abut on the sheet-like connected staple through the through-hole formed in the cartridge main body, the other latch portion of the lock member oscillates in the latching direction to latch the engaging member. When the abutting portion does not abut on the sheet-like connected staple, the latch portion oscillates in the unlatching direction to unlatch the engaging member. Thus, the cartridge according to the invention has the effect that the lock member locks the staple refill when the lock member detects the existence of the sheet-like connected staple while the lock member unlocks the staple refill when the lock member does not detect the existence of the sheet-like connected staple.

DESCRIPTION OF THE REFERENCE NUMERALS AND SIGNS

S sheet-like connected staple
S1 leading end portion
S2 upper surface
S3 lower surface
S4 roll winding portion
S5 drawn-forth portion
1 staple refill
2 refill main body
2*a* front portion
3 uppercase
5 lower case
6 upper wall
7 left wall 7*a* circular wall 7*b* lower wall
8 opening
9 right wall 9*a* circular wall 9*b* lower wall
11 upper semi-cylindrical wall
12 vertical wall
13 curved wall
13*a* lower surface (upper guide surface)
14 latch hole
15 horizontal wall
15*a* lower surface
16 engaging shaft
18 grip arm
19 rib
20 guide projection strip
21 lower wall
22 arc wall
23 linear wall
23*a* upper surface
25 guide projection (guide projection portion)
26 one surface (lower guide surface)
27 the other surface
29 top portion
30 notch portion
31 backward movement preventing member
31*a* leading edge
32 notch recessed portion
35 guide band (projection strip)
36 latch pawl
40 storage chamber (storage portion)
42 second guide passage
43 first guide passage
45 delivery passage
46 discharge port
47 upper guide surface
48 lower guide surface
52 lower wall
53 engaging projection
55 backward movement preventing member
56 insertion plate
57 lower case
58 guide projection
59 one surface
60 long hole
61 stapler
62 stapler main body
63 cartridge storage portion
65 engaging recessed portion
66 arm member
67 leading end portion
70 cartridge
70A cartridge main body
71 bottom plate
72 right guide plate
73 right side plate
74 through-hole
75 left guide plate
76 left side plate
77 rear plate
77*a* rear face plate
77*b* left bent plate
77*c* right bent plate
78 opening
79 front plate
80 staple punch-out guide
81 latch portion
82 storage chamber
83 cover
85 engaging member
86 movable plate
87 left engaging plate
88 right engaging plate
89 engaging projection

90 latch groove
91 support shaft
92 elastic member
95 lock member
96 pivot
97 abutting portion
98 latch portion
99 latch projection
100 feeding means
105 operation lever
106 handle portion
107 arm
109 engaging piece
111 intermediate portion
112 attachment shaft
113 guide shaft
115 latch portion

INDUSTRIAL APPLICABILITY

The invention can be applied to a motor-driven stapler with which a copying machine, a printing machine, and the like are equipped.

The invention claimed is:

1. A cartridge drawably provided in a stapler main body comprising:

a cartridge main body provided with a storage chamber for detachably storing a staple refill, an engaging member for engaging one side of the staple refill stored in the storage chamber and a lock member for locking the engaging member;

wherein the lock member has an abutting portion, wherein the lock member is structured such that the abutting portion abuts on a sheet-like connected staple discharged from a discharge port of the staple refill when the staple refill is stored in said storage chamber;

wherein the lock member is configured to lock the engaging member to prevent the release of the staple refill when the abutting portion abuts on the sheet-like connected staple;

wherein the lock member is configured to unlock said engaging member to enable the release of the staple refill when the abutting portion does not abut on the sheet-like connected staple;

wherein the lock member is provided in the cartridge main body such that it can oscillate, having the abutting portion formed at one end of the lock member and a latch portion formed at the other end;

wherein the abutting portion emerges into the storage chamber to abut on the sheet-like connected staple through a through-hole formed in said cartridge main body;

wherein the latch portion latches said engaging member by oscillating the latch portion of the lock member in a latching direction when the abutting portion abuts on the sheet-like connected staple; and, wherein the lock member unlatches the engaging member by oscillating the latch portion of the lock member in an unlatching direction when the abutting portion does not abut on the sheet-like connected staple.

2. A cartridge attached to a stapler for binding sheets of paper with a staple comprising:

a storage chamber for detachably storing a staple refill accommodating the staple, an engaging member engaging the staple refill stored in the storage chamber for preventing release of the staple refill from the storage chamber and a lock member latching the engaging member for preventing the release of the engagement between the staple refill and the engaging member;

wherein the lock member includes an abutting portion abutting on the staple accommodated in the staple refill;

wherein the lock member latches said engaging member by abutment between the abutting portion and the staple in the staple refill;

wherein the lock member prevents the release of engagement between the engaging member and the staple refill;

wherein the lock member is provided in a main body of the cartridge such that it can oscillate, having the abutting portion formed at one end of the lock member and a latch portion formed at the other end;

wherein the abutting portion emerges into the storage chamber to abut on the sheet-like connected staple through a through-hole formed in said cartridge main body;

wherein the latch portion latches said engaging member by oscillating the latch portion of the lock member in a latching direction when the abutting portion abuts on the sheet-like connected staple; and, wherein the lock member unlatches the engaging member by oscillating the latch portion of the lock member in an unlatching direction when the abutting portion does not abut on the sheet-like connected staple.

* * * * *